US012799555B2

(12) United States Patent
Maki et al.

(10) Patent No.: US 12,799,555 B2
(45) Date of Patent: Nov. 17, 2026

(54) THIN STEEL SHEET

(71) Applicant: NIPPON STEEL CORPORATION, Tokyo (JP)

(72) Inventors: Jun Maki, Tokyo (JP); Masaharu Fukui, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 635 days.

(21) Appl. No.: 18/034,616

(22) PCT Filed: Feb. 2, 2021

(86) PCT No.: PCT/JP2021/003753
§ 371 (c)(1),
(2) Date: Apr. 28, 2023

(87) PCT Pub. No.: WO2022/168167
PCT Pub. Date: Aug. 11, 2022

(65) Prior Publication Data

US 2024/0018617 A1 Jan. 18, 2024

(51) Int. Cl.

| | |
|---|---|
| ***C21D 9/46*** | (2006.01) |
| ***C21D 8/02*** | (2026.01) |
| ***C21D 8/0221*** | (2026.01) |
| ***C22C 38/02*** | (2006.01) |
| ***C22C 38/04*** | (2006.01) |
| ***C22C 38/06*** | (2006.01) |

(52) U.S. Cl.
CPC ..... *C21D 9/46* (2013.01); *C21D 8/0226* (2013.01); *C22C 38/02* (2013.01); *C22C 38/04* (2013.01); *C22C 38/06* (2013.01)

(58) Field of Classification Search
None
See application file for complete search history.

(56) References Cited

U.S. PATENT DOCUMENTS

| | | | | |
|---|---|---|---|---|
| 2017/0306507 | A1* | 10/2017 | Masuoka | C22C 38/04 |
| 2018/0037969 | A1 | 2/2018 | Yoshioka et al. | |
| 2020/0354823 | A1* | 11/2020 | Pipard | C22C 38/34 |
| 2022/0282351 | A1 | 9/2022 | Takeda et al. | |

FOREIGN PATENT DOCUMENTS

| | | | |
|---|---|---|---|
| CN | 107429344 | A | 12/2017 |
| JP | 2015-98620 | A | 5/2015 |
| JP | 2016-84520 | A | 5/2016 |
| WO | WO 2019/092483 | A1 | 5/2019 |
| WO | WO 2020/203158 | A1 | 10/2020 |

* cited by examiner

*Primary Examiner* — Xiaowei Su
(74) *Attorney, Agent, or Firm* — Birch, Stewart, Kolasch & Birch, LLP

(57) ABSTRACT

A thin steel sheet having a chemical composition satisfying 0.0001≤[Sn]+0.3[Cu]+0.1[Cr]≤0.2000 ([Sn], [Cu], and [Cr] respectively being the contents (mass %) of Sn, Cu, and Cr), having an oxide film of a thickness of 50 nm or less on the surface, and satisfying A/C<0.30 and B/C<3.0 when measuring the oxide film by the FT-IR reflectance method (A is an area of a peak derived from $SiO_2$, B is an area of a peak derived from $MnSiO_3$, and C is an area of a peak derived from $Mn_2SiO_4$).

11 Claims, 2 Drawing Sheets

THIN STEEL SHEET

FIELD

The present invention relates to a thin steel sheet. More specifically, the present invention relates to a high strength thin steel sheet maintaining end-face corrosion resistance while having improved chemical convertibility.

BACKGROUND

In recent years, the steel sheet used in automobiles, household electric appliances, building materials, and other various fields has been made increasingly higher in strength. For example, in the automotive field, a high strength steel sheet is being increasingly used for the purpose of reducing the weight of car bodies so as to improve fuel efficiency. Such a high strength steel sheet typically contains C, Si, Mn, and other elements for enhancing the strength of the steel.

A steel sheet, in particular a thin steel sheet for automotive use, is usually used with the steel sheet surface coated (typically by cationic electrodeposition coating) so as to impart desired properties (for example, corrosion resistance). As pretreatment for such coating, it is known to treat the steel sheet surface for chemical conversion (for example, treat it by zinc phosphate) for the purpose of improving the adhesion between the coating film formed by the coating operation and the steel sheet, etc. Therefore, in general, a steel sheet is being required to have excellent chemical convertibility enabling uniform formation of chemical conversion crystals on the steel sheet surface.

On the other hand, a steel sheet having the above electrodeposition coating generally has a tendency to be easily corroded from the end face parts. This is because electrodeposition coatings tend to become relatively thin near the end faces, in particular, at the projecting parts of the end faces, and as a result those parts become starting points of corrosion. The corrosion starting at points near the end faces proceeds through the interface of the steel sheet and coating film. Along with the progression of corrosion, the steel sheet is reduced in thickness and is worn down. To inhibit progression of corrosion of such steel sheet (base steel), it is desirable that the steel sheet itself be excellent in corrosion resistance (in particular end-face corrosion resistance). Furthermore, if a steel sheet is excellent in chemical convertibility, a chemically converted film is sufficiently formed even at the vicinity of the end faces and progression of corrosion at the interface of the steel sheet and coating film is inhibited.

PTL 1 describes steel sheet for automotive use containing C, Si, Mn, Al, Sn, etc., having a base iron surface roughness (average roughness Ra) of 0.5 to 2 μm, and excellent in chemical convertibility and corrosion resistance. Further, PTL 2 describes a high workability high strength cold rolled steel sheet excellent in chemical convertibility containing C, Si, Mn, Al, Sb, etc., having a tensile strength TS of 780 MPa or more, having a product TS×EL of the TS and elongation EL (%) of 18000 MPa % or more, and having a variation of hardness ΔHv in the sheet thickness direction of 20 or less.

CITATIONS LIST

Patent Literature

[PTL 1] Japanese Unexamined Patent Publication No. 2015-98620

[PTL 2] Japanese Unexamined Patent Publication No. 2016-84520

SUMMARY

Technical Problem

The chemical conversion treatment performed as pretreatment for coating steel sheet is a kind of corrosion reaction at the steel sheet surface. For this reason, if the steel sheet itself is greatly improved in corrosion resistance, it will become harder for a reaction in which the steel sheet dissolves in the chemical conversion treatment solution to occur and therefore the chemical convertibility will fall. That is, the chemical convertibility and corrosion resistance are generally often in a tradeoff relationship. It is important to realize both of these contradictory properties. Furthermore, in a high strength steel sheet, Si and Mn are contained, therefore there is also the problem that oxides of these elements form at the steel sheet surface and cause a further fall in the chemical convertibility.

The invention described in PTL 1 tries to achieve both chemical convertibility and corrosion resistance by optimization of the steel constituents for improvement of the corrosion resistance through addition of Sn and other corrosion resistance elements and optimization of the steel surface roughness for improvement of the chemical convertibility. However, in PTL 1, the effects of addition of corrosion resistance elements other than Sn on the chemical convertibility, etc., have not necessarily been sufficiently studied. For this reason, in the invention described in PTL 1, there was still room for improvement relating to achieving both chemical convertibility and corrosion resistance.

The invention described in PTL 2 is made to contain Sb so as to try to improve the chemical convertibility, but improvement of the corrosion resistance, in particular the end-face corrosion resistance, has not been sufficiently studied.

The present invention, in view of such a situation, has as its object the provision of a high strength thin steel sheet maintaining end-face corrosion resistance while having improved chemical convertibility.

Solution to Problem

The inventors discovered that to obtain a high strength thin steel sheet maintaining end-face corrosion resistance while having improved chemical convertibility, it is important to make the steel sheet include predetermined amounts of C, Si and Mn, and, furthermore, to consider the degrees of influence of Sn, Cu and Cr among the elements included in the steel sheet on the corrosion resistance and chemical convertibility and more strictly control the contents of these elements in the steel, and to control the composition of a oxide film formed on the steel sheet surface within a predetermined range.

The present invention was made based on the above discovery and has as its gist the following:

[1] A thin steel sheet having a chemical composition comprising, by mass %,
C: 0.050 to 0.300%,
Si: 0.10 to 4.00%,
Mn: 0.80 to 6.00%,
Al: 0.010 to 2.000%,
P: 0 to 0.100%,
S: 0 to 0.100%,
N: 0 to 0.0300%,
Ni: 0 to 0.05%,
Cu: 0 to 0.50%,
Cr: 0 to 1.00%,
Mo: 0 to 0.50%,
Ti: 0 to 0.200%,
Nb: 0 to 0.100%,
B: 0 to 0.0200%,
Sn: 0 to 0.2000%,
Sb: 0 to 0.0300%,
V: 0 to 0.50%,
W: 0 to 0.50%,
Ca: 0 to 0.0100%,
REM: 0 to 0.0100%, and
balance: Fe and impurities, and satisfying the following formula (1), and
an oxide film having a thickness of 50 nm or less on its surface, and satisfying the following formulas (2) and (3) when measuring the oxide film by an FT-IR reflectance method:

$$0.0001 \leq [Sn] + 0.3[Cu] + 0.1[Cr] \leq 0.2000 \quad (1)$$

(where, when the thin steel sheet is a cold rolled steel sheet, $0.0001 \leq [Sn] + 0.3[Cu] + 0.1[Cr] \leq 0.0500$)

where [Sn], [Cu] and [Cr] respectively are the contents (mass %) of Sn, Cu, and Cr.

$$A/C < 0.30 \quad (2)$$

$$B/C < 3.0 \quad (3)$$

where A is an area of a peak derived from $SiO_2$, B is an area of a peak derived from $MnSiO_3$, and C is an area of a peak derived from $Mn_2SiO_4$.

[2] The thin steel sheet according to the above [1], wherein the thin steel sheet is a hot rolled steel sheet.

[3] The thin steel sheet according to the above [1], wherein the chemical composition comprises, by mass %,
Cu: 0 to 0.10%,
Cr: 0 to 0.50%, and
Sn: 0 to 0.0500%, and satisfies the following formula (1'), and
the thin steel sheet is a cold rolled steel sheet:

$$0.0001 \leq [Sn] + 0.3[Cu] + 0.1[Cr] \leq 0.0500 \quad (1')$$

where [Sn], [Cu] and [Cr] respectively are the contents (mass %) of Sn, Cu and Cr.

[4] The thin steel sheet according to any one of the above [1] to [3], not having on the surface of the thin steel sheet, a plating layer having a chemical composition comprising at least one of Ni, Zn and Co and balance of Fe and impurities.

[5] The thin steel sheet according to any one of the above [1] to [4], having a tensile strength of 340 MPa or more.

[6] The thin steel sheet according to any one of the above [1] to [4], having a tensile strength of 440 MPa or more.

Advantageous Effects of Invention

According to the present invention, it is possible to provide a high strength thin steel sheet maintaining end-face corrosion resistance while having improved chemical convertibility. In particular, the thin steel sheet according to the present invention has excellent chemical convertibility, therefore for example it becomes possible to not provide a plating layer, etc., on the thin steel sheet to improve the chemical convertibility and to directly chemically convert the thin steel sheet. Therefore, according to the present invention, when performing chemical conversion, for example, it is possible to eliminate facilities for such plating use and facilities for pretreatment. This is extremely advantageous from the viewpoint of cutting costs.

DESCRIPTION OF EMBODIMENTS

<Thin Steel Sheet>

Figure 1:
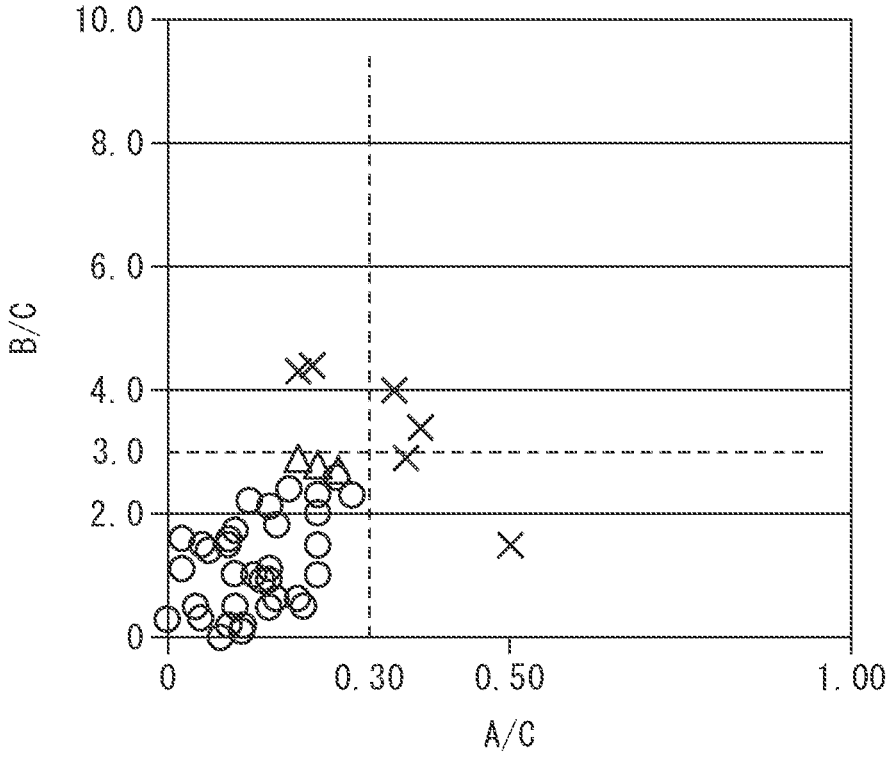
FIG. 1 is a view of evaluations relating to chemical convertibility of the examples in Examples X and Y (○ (good), Δ (fair), and x (poor)) when plotting the A/C values along the abscissa and the B/C values along the ordinate.

The thin steel sheet of the present invention strictly controls the contents of in particular the Sn, Cu, and Cr in the elements contained in the steel sheet and controls the composition of the oxide film formed on the steel sheet surface within a predetermined range to thereby improve the end-face corrosion resistance and chemical convertibility. The thin steel sheet of the present invention is not particularly limited, but for example can have a 0.1 to 4.0 mm thickness. The thin steel sheet of the present invention can be realized by the specific embodiments shown below. Below, the specific Embodiments 1 and 2 for realizing the thin steel sheet of the present invention will be explained in more detail, but these explanations are intended to be just illustrations of the preferred embodiments of the present invention and are not intended to limit the present invention to such specific embodiments. In the present invention, the cold rolled steel sheet of the Embodiment 1 and the hot rolled steel sheet of the Embodiment 2 explained in detail later will be referred to all together as the "thin steel sheet" and, when necessary, simply abbreviated as the "steel sheet".

Embodiment 1

The thin steel sheet according to the Embodiment 1 of the present invention is a cold rolled steel having a chemical composition comprising, by mass %,
C: 0.050 to 0.300%,
Si: 0.10 to 4.00%,
Mn: 0.80 to 6.00%, Al: 0.010 to 2.000%,
P: 0 to 0.100%,
S: 0 to 0.100%,
N: 0 to 0.0300%,
Ni: 0 to 0.05%,
Cu: 0 to 0.10%,
Cr: 0 to 0.50%,
Mo: 0 to 0.50%,
Ti: 0 to 0.200%,
Nb: 0 to 0.100%,
B: 0 to 0.0200%,
Sn: 0 to 0.0500%,
Sb: 0 to 0.0300%,
V: 0 to 0.50%,
W: 0 to 0.50%,
Ca: 0 to 0.0100%,
REM: 0 to 0.0100%, and
balance: Fe and impurities, and satisfying the following formula (1'), and
an oxide film having a thickness of 50 nm or less on its surface, and satisfying the following formulas (2) and (3) when measuring the oxide film by an FT-IR reflectance method:

$$0.0001 \leq [Sn] + 0.3[Cu] + 0.1[Cr] \leq 0.0500 \quad (1')$$

where [Sn], [Cu] and [Cr] respectively are the contents (mass %) of Sn, Cu, and Cr.

$$A/C < 0.30 \quad (2)$$

$$B/C < 3.0 \quad (3)$$

where A is an area of a peak derived from $SiO_2$, B is an area of a peak derived from $MnSiO_3$, and C is an area of a peak derived from $Mn_2$ $SiO_4$.

A cold rolled steel sheet having a high strength (tensile strength of 340 MPa or more) for automotive use is desired to have excellent chemical convertibility. The chemical conversion treatment for example [1] is sometimes performed on a plating layer provided on the cold rolled steel sheet and containing Ni, Zn, Co, etc., and [2] is sometimes performed directly on the cold rolled steel sheet. In the case of [1], usually the cold rolled steel sheet is pickled, then the cold rolled steel sheet is formed with a plating layer excellent in chemical convertibility (for example, an Ni plating or a small plating thickness Ni flash plating layer or Zn plating layer) and then is treated for chemical conversion on top of that. In this case, due to the presence of the plating layer, even if the cold rolled steel sheet itself is not sufficient in chemical convertibility, the cold rolled steel sheet having that plating layer has sufficient chemical convertibility, therefore good chemical conversion treatment can be applied. For this reason, the effect of the chemical composition of the steel sheet on the chemical conversion treatment is not necessarily great.

However, among the facilities used for producing a high strength steel sheet, there are many facilities which are unable to perform either or both of pickling treatment and plating treatment. In such a case, i.e., in the case of [2], for example, chemical conversion treatment is directly performed on the cold rolled steel sheet after degreasing or other cleaning steps. In this case, there is no plating layer present on the cold rolled steel sheet, therefore if the steel sheet itself is not sufficient in chemical convertibility, the chemical conversion treatment is liable to not be performed well. For this reason, the chemical composition and surface conditions of the steel sheet will have an extremely great effect on the chemical conversion treatment.

In this Description ("this Description" meaning the Description as a whole including also the later explained Embodiment 2), "chemical convertibility" means the ease of formation of chemical conversion crystals at the surface of the steel sheet in the case of treating the surface of the steel sheet by predetermined chemical conversion (for example, zinc phosphate treatment). Accordingly, in this Description, "improved chemical convertibility" and "excellent in chemical convertibility" mean uniform formation of chemical conversion crystals on the surface of the steel sheet after chemical conversion and little or no parts where chemical conversion crystals are not formed and the steel sheet is exposed.

First, the inventors analyzed in detail the relationship between the chemical composition of steel sheet and chemical convertibility so as to obtain a cold rolled steel sheet excellent in chemical convertibility enabling excellent chemical conversion even when not providing a plating layer, etc., on the steel sheet. As a result, the inventors discovered that among the constituents contained in steel sheet, Sn, Cu, and Cr cause the chemical convertibility to fall. Further, the inventors analyzed in detail the degrees of effects of these elements on the chemical convertibility and as a result discovered that the degrees of effect, i.e., the degrees of effect of causing the chemical convertibility to fall, are Sn>Cu>Cr. More specifically, they discovered that the value found by the following formula (A) can be used to express well the relationship between the "contents (mass %) of Sn, Cu, and Cr" and the "chemical convertibility" and that when a cold rolled steel sheet is directly chemically converted (case of above [2]), to ensure sufficient chemical convertibility, the value found by the following formula (A) has to be 0.0500% or less:

$$[Sn] + 0.3[Cu] + 0.1[Cr] \quad (A)$$

where [Sn], [Cu] and [Cr] respectively are the contents (mass %) of Sn, Cu and Cr, when not contained (when not measured by analysis), 0 being entered. In the case of a hot rolled steel sheet in the Embodiment 2 explained in detail later, after cold rolling, pickling is usually performed for removing the scale and the surface properties of the steel sheet are improved, but in the case of a cold rolled steel sheet, such pickling is generally not performed after cold rolling. For this reason, to maintain sufficient chemical convertibility in the cold rolled steel sheet, compared with the case of the Embodiment 2, it is necessary to control the value found by formula (A) more strictly, i.e., unlike the 0.2000% or less of the Embodiment 2, the value has to be controlled to 0.0500% or less.

On the other hand, in the high strength cold rolled steel sheet for automotive use, household electric appliances, building materials, etc., usually a high corrosion resistance is sought. More specifically, in the cold rolled steel sheet for automotive use, etc., both flat surface corrosion resistance and end-face corrosion resistance are demanded. "Flat surface corrosion resistance" is corrosion resistance at the flat surface part (surface part) of steel sheet. This usually can be secured by the presence of a coating film formed by coating the steel sheet surface. On the other hand, "end-face corrosion resistance" means the corrosion resistance of end face parts when steel sheet is cut, then coated by electrodeposition. As explained earlier, at the projecting parts of the end faces, the electrodeposition coating becomes thinner, therefore the end face parts easily become starting points of corrosion.

In relation to this, the elements Sn, Cu, and Cr described in the above formula (A) are known to be elements contributing to improvement of the corrosion resistance of the steel itself. Therefore, the inventors analyzed the relationship between the "contents (mass %) of Sn, Cu, and Cr" and the "end-face corrosion resistance" and as a result discovered that in order for the steel to maintain a sufficient end-face corrosion resistance, the value found by the above (A) has to be 0.0001% or more.

As explained above, to obtain a high strength cold rolled steel sheet maintaining end-face corrosion resistance while having improved chemical convertibility, it is extremely important to control the amounts of Sn, Cu, and Cr in the cold rolled steel sheet, more specifically, to control the value found by formula (A) to 0.0001% or more and 0.0500% or less, i.e., within the range satisfying the following formula (1'):

$$0.0001 \leq [Sn] + 0.3[Cu] + 0.1[Cr] \leq 0.0500 \quad (1')$$

where [Sn], [Cu] and [Cr] respectively are the contents (mass %) of Sn, Cu, and Cr.

The contents of the elements contained in the cold rolled steel sheet are determined in large part by adjusting the chemical composition of the molten steel when producing the slab to be used for the hot rolling step. However, the cold rolled steel sheet obtained by cold rolling (and optionally annealing) after hot rolling the above slab can also contain elements other than the elements intentionally added when adjusting the chemical composition of the molten steel. For example, in the production of steel sheet, in general, scrap is often used from the viewpoint of reducing the production costs. The elements mixed in the scrap will possibly be contained in the finally obtained cold rolled steel sheet. The above-mentioned Sn, Cu, and Cr are all known to be elements possibly contained in scrap. Therefore, these elements are sometimes contained in the finally obtained cold rolled steel sheet even if not intentionally added into the steel. In particular, the above elements are not completely removed in the process of melting and refining by an electric furnace. Therefore, these elements are present in the scrap and as a result are contained in the final product. Further, Sn, Cu, and Cr are sometimes unavoidably contained in production in addition to being contained in the scrap.

Therefore, to obtain a cold rolled steel sheet excellent in end-face corrosion resistance and chemical convertibility, in particular chemical convertibility, it is important to consider the amounts of Sn, Cu, and Cr which will be finally contained in the cold rolled steel sheet due to the use of scrap, etc., and suitably and strictly control the chemical composition in the finally obtained cold rolled steel sheet. For example, if not intentionally adding the above elements, it is sufficient to sufficiently manage the elements contained in the scrap or manage the ratio of scrap used for production, etc., so as to manage and control the chemical composition of the cold rolled steel sheet.

Furthermore, the inventors also studied in detail the relationship between the surface conditions of steel sheet and chemical convertibility. As a result, the inventors discovered that just controlling the chemical composition of the steel sheet so that the above formula (A) becomes 0.0500% or less was not necessarily sufficient from the viewpoint of the improvement of the chemical convertibility and that in addition to that, it is necessary to control the composition of the oxide film formed on the steel sheet surface within a predetermined range. More specifically, the inventors discovered that to improve the chemical convertibility of steel sheet, it is necessary to control the oxide film on the steel sheet surface to 50 nm or less while, when measuring the oxide film by the FT-IR reflectance method, satisfying the following formulas (2) and (3):

$$A/C < 0.30 \quad (2)$$

$$B/C < 3.0 \quad (3)$$

where A is an area of a peak derived from $SiO_2$, B is an area of a peak derived from $MnSiO_3$, and C is an area of a peak derived from $Mn_2\ SiO_4$.

Explained more specifically in relation to this, in a high strength steel sheet, in the process of production, sometimes oxygen diffuses into the steel surface from the scale layer mainly comprised of FeO present on the steel sheet and from the external atmosphere and bonds with the Si, Mn, or other elements contained in the steel to form an oxide film on the surface of the steel sheet. Such an oxide film lowers the chemical convertibility the thicker it becomes. Further, in addition to the thickness of the oxide film, the composition of the oxide film is also important. If the oxide film is comprised of Si-rich oxides, it is considered that the steel sheet will fall in chemical convertibility. Therefore, from the viewpoint of improvement of the chemical convertibility, it is considered preferable to keep the thickness of the oxide film within a predetermined range while making the oxide film be comprised of not Si-rich oxides, but Mn-rich oxides. More specifically, as the specific oxides comprising the oxide film formed on the high strength steel containing Si and Mn, there are $SiO_2$, $MnSiO_3$, and $Mn_2\ SiO_4$. These oxides, if expressed by the general formula $nMnO{\cdot}SiO_2$, can respectively be expressed as follows:

$$SiO_2 = 0MnO{\bullet}SiO_2\ (n = 0) \quad MnSiO_3 = 1MnO{\bullet}SiO_2\ (n = 1)$$

$$Mn_2SiO_4 = 2MnO{\bullet}SiO_2\ (n = 2)$$

From these formulas, it will be learned that Si-rich oxides change to Mn-rich oxides in the order of $SiO_2$, $MnSiO_3$, and $Mn_2\ SiO_4$. Therefore, if measuring an oxide film by the FT-IR reflectance method and designating the area of a peak derived from $SiO_2$ as A, the area of a peak derived from $MnSiO_3$ as B, and the area of a peak derived from $Mn_2\ SiO_4$ as C, it will be learned that controlling A/C and B/C respectively to values lower than predetermined values means rendering the composition of the oxide film more Mn-rich oxides. The inventors engaged in further studies based on such findings and as a result discovered that by controlling A/C and B/C respectively within ranges of less than 0.30 and less than 3.0 as shown in the above formulas (2) and (3) so as to render the composition of the oxide film more Mn-rich oxides, it is possible to remarkably improve the chemical convertibility of the steel sheet.

While not intending to be constrained by any specific theory, it is believed that the formation of the above oxide film is closely related to the concentration of Sn, Cu, and Cr at the steel sheet surface. Explained more specifically, Sn, Cu, and Cr have the properties of easily concentrating at the steel sheet surface. It is believed that formation of Si-rich oxides is promoted by surface concentration of these elements. Therefore, for inhibiting the formation of Si-rich oxides, i.e., rendering the oxide film more Mn-rich oxides to improve the chemical convertibility of the steel sheet, inhibiting the surface concentration of Sn, Cu, and Cr becomes important. According to the present embodiment, by controlling the amounts of Sn, Cu, and Cr in the steel sheet within predetermined ranges as shown in the above formula (1') while inhibiting the concentration of these elements at the steel sheet surface so as to render the composition of the oxide film formed on the steel sheet surface due to the Si or Mn generally added in high strength steel sheet a suitable one, it becomes possible to obtain a high strength cold rolled steel sheet maintaining sufficient end-face corrosion resistance while excellent in chemical convertibility. Below, the constituent elements of the cold rolled steel sheet according to the Embodiment 1 will be explained in detail. Some of the constituent elements among the constituent elements of the cold rolled steel sheet according to the Embodiment 1 are shared in the Embodiment 2 as well. Therefore, the explanations relating to constituent elements shared in common at the two embodiments will apply not only to the Embodiment 1, but also the Embodiment 2.

[Cold Rolled Steel Sheet]

The thickness of cold rolled steel sheet according to the Embodiment 1 is not particularly limited, but, for example, may be 0.1 to 3.2 mm. The thickness may also be 0.6 mm or more or 1.0 mm or more and/or may be 2.5 mm or less or 2.0 mm or less.

[Chemical Composition]

The chemical composition contained in the cold rolled steel sheet according to the present embodiment will be explained next. The "%" relating to the contents of the elements means "mass %" unless particularly indicated otherwise. Further, the numerical values shown below are values obtained by analyzing the cold rolled steel sheet by the inductively coupled plasma mass spectrometry method (ICP-MS method), etc. Therefore, in this Description, the "chemical composition" includes not only constituents derived from elements intentionally added at the time of production, but also constituents unavoidably mixed into the steel in the production of the cold rolled steel sheet (for example, constituents derived from elements contained in the scrap). In the numerical ranges in the chemical composition, the numerical ranges expressed using "to", unless particularly indicated otherwise, mean the ranges including the numerical values described before and after the "to" as the lower limit values and upper limit values.

[C: 0.050 to 0.300% (Shared in Common in Embodiments 1 and 2)]

C (carbon) is an element important in securing the strength of the cold rolled steel sheet. To secure sufficient strength, the C content is 0.050% or more. The C content is preferably 0.070% or more, more preferably 0.100% or more, still more preferably 0.120% or more. On the other hand, if the C content is excessive, the weldability is liable to fall. Therefore, the C content is or less. The C content may also be 0.250% or less, 0.230% or less, or 0.200% or less.

[Si: 0.10 to 4.00% (Shared in Common in Embodiments 1 and 2)]

Si (silicon) is an element effective for improving the strength of the steel sheet. To secure sufficient strength, the Si content is 0.10% or more. The Si content is preferably 0.20% or more, more preferably 0.50% or more, still more preferably 1.00% or more. On the other hand, if the Si content is excessive, the surface properties are liable to be caused to deteriorate. Further, sometimes an Si-based oxide film will form on the steel sheet surface and lower the chemical convertibility. Therefore, the Si content is 4.00% or less. The Si content may also be 3.50% or less, 3.00% or less, 2.50% or less, or 2.00% or less.

[Mn: 0.80 to 6.00% (Shared in Common in Embodiments 1 and 2)]

Mn (manganese) is an element effective for obtaining hard structures and thereby improving the strength of the steel sheet. To secure sufficient strength, the Mn content is 0.80% or more. The Mn content is preferably 1.00% or more, more preferably 1.50% or more, still more preferably 2.00% or more. On the other hand, if excessively adding Mn, the metallic structure becomes uneven due to Mn segregation and the workability is liable to decline. Therefore, the Mn content is 6.00% or less. The Mn content may also be 5.50% or less, 5.00% or less, 4.50% or less, 4.00% or less, 3.50% or less, or 3.00% or less.

[Al: 0.010 to 2.000% (Shared in Common in Embodiments 1 and 2)]

Al (aluminum) is an element acting as a deoxidizing element. To obtain a sufficient deoxidizing effect, the Al content is 0.010% or more. The Al content may also be 0.020% or more, 0.025% or more, or 0.030% or more. On the other hand, if excessively including Al, a fall in the workability or deterioration of the surface properties is liable to be caused. Therefore, the Al content is 2.000% or less. The Al content may also be 1.500% or less, 1.000% or less, 0.500% or less, 0.100% or less, or 0.050% or less.

[P: 0 to 0.100% (Shared in Common in Embodiments 1 and 2)]

P (phosphorus) is an impurity generally contained in steel. If excessively containing P, the weldability is liable to fall. Therefore, the P content is 0.100% or less. The P content is preferably 0.080% or less, more preferably 0.050% or less, still more preferably 0.030% or less or 0.020% or less. The lower limit of the P content is 0%, but from the viewpoint of the production costs, the P content may be more than 0% or 0.001% or more.

[S: 0 to 0.100% (Shared in Common in Embodiments 1 and 2)]

S (sulfur) is an impurity generally contained in steel. If excessively containing S, the weldability is liable to fall and, furthermore, the amount of precipitation of MnS is liable to increase and the bendability and other workability are liable to fall. Therefore, the S content is 0.100% or less. The S content is preferably 0.080% or less, more preferably 0.050% or less, still more preferably 0.020% or less. The lower limit of the S content is 0%, but from the viewpoint of the desulfurization costs, the S content may be more than 0% or 0.001% or more.

[N: 0 to 0.0300% (Shared in Common in Embodiments 1 and 2)]

N (nitrogen) is an impurity generally contained in steel. If excessively containing N, the weldability is liable to fall. Therefore, the N content is 0.0300% or less. The N content is preferably 0.0200% or less, more preferably 0.0100% or less, still more preferably 0.0050% or less. The lower limit of the N content is 0%, but from the viewpoint of the production costs, the N content may be more than 0% or 0.0010% or more.

The basic chemical composition of the cold rolled steel sheet according to the Embodiment 1 is as explained above. Furthermore, the cold rolled steel sheet may contain the following optional elements in accordance with need. Inclusion of these elements is not essential. The lower limits of the contents of these elements are 0%.

[Ni: 0 to 0.05% (Shared in Common in Embodiments 1 and 2)]

Ni (nickel) is an element contributing to improvement of the strength or corrosion resistance of the steel. The Ni content may be 0%, but the element may be included in accordance with need to obtain the above effect. The Ni content may also be 0.01% or more or 0.02% or more. On the other hand, from the viewpoint of the production costs, etc., the Ni content is preferably 0.05% or less and may also be 0.04% or less or 0.03% or less.

[Cu: 0 to 0.10%]

Cu (copper) is an element contributing to improvement of the strength or corrosion resistance of the steel. On the other hand, as explained above, Cu is an element causing a fall in chemical convertibility second to Sn. In the present invention, it is important to strictly manage the Cu content in the steel obtained after rolling. To secure sufficient chemical convertibility, the Cu content is 0.10% or less, preferably 0.08% or less, more preferably 0.05% or less. From the viewpoint of further improving the chemical convertibility, the lower limit of the Cu content may also be 0%. On the other hand, to improve the corrosion resistance of steel, in particular the end-face corrosion resistance, the Cu content may also be for example 0.001% or more, 0.002% or more, 0.005% or more, or 0.01% or more.

[Cr: 0 to 0.50%]

Cr (chromium) is an element contributing to improvement of the strength or corrosion resistance of the steel. On the other hand, as explained above, Cr is an element causing a fall in chemical convertibility second to Sn and Cu. In the present invention, it is important to strictly manage the Cr content in the steel obtained after rolling. To secure sufficient chemical convertibility, the Cr content is 0.50% or less, preferably 0.40% or less, more preferably 0.30% or less, still more preferably 0.20% or less. From the viewpoint of further improving the chemical convertibility, the lower limit of the Cr content may also be 0%. On the other hand, to improve the corrosion resistance of steel, in particular the end-face corrosion resistance, the Cr content may also be for example 0.01% or more, 0.02% or more, 0.03% or more, 0.05% or more, or 0.10% or more.

[Mo: 0 to 0.50% (Shared in Common in Embodiments 1 and 2)]

Mo (molybdenum) is an element contributing to improvement of the strength or corrosion resistance of the steel. The Mo content may be 0%, but the element may be included in accordance with need to obtain the above effect. The Mo content may also be 0.01% or more or 0.02% or more. On the other hand, from the viewpoint of securing sufficient toughness and weldability, the Mo content is preferably 0.50% or less and may also be 0.40% or less, 0.30% or less, 0.10% or less, or 0.05% or less.

[Ti: 0 to 0.200% (Shared in Common in Embodiments 1 and 2)]

Ti (titanium) is an element precipitating as TiC during the cooling of the steel and contributing to improvement of the strength. The Ti content may be 0%, but the element may be included in accordance with need to obtain the above effect. The Ti content may also be 0.010% or more or 0.020% or more. On the other hand, if excessively containing Ti, coarse TiN is formed and the toughness is liable to be impaired. For this reason, the Ti content is preferably 0.200% or less and may also be 0.180% or less, 0.150% or less, 0.100% or less, 0.060% or less, or 0.040% or less.

[Nb: 0 to 0.100% (Shared in Common in Embodiments 1 and 2)]

Nb (niobium) is an element contributing to improvement of strength through improvement of hardenability. The Nb content may be 0%, but the element may be included in accordance with need to obtain the above effect. The Nb content may also be 0.005% or more, 0.010% or more, or 0.015% or more. On the other hand, from the viewpoint of securing sufficient toughness and weldability, the Nb content is preferably 0.100% or less and may also be 0.080% or less, 0.060% or less, 0.040% or less, or 0.030% or less.

[B: 0 to 0.0200% (Shared in Common in Embodiments 1 and 2)]

B (boron) is an element raising the hardenability and contributing to improvement of the strength and further segregating at the grain boundaries to strengthen the grain boundaries and improve the toughness. The B content may be 0%, but the element may be included in accordance with need to obtain the above effect. The B content may also be 0.0005% or more, 0.0010% or more, or 0.0015% or more. On the other hand, from the viewpoint of securing sufficient toughness and weldability, the B content is preferably 0.0200% or less and may also be 0.0150% or less, 0.0100% or less, 0.0050% or less, 0.0030% or less, or 0.0020% or less.

[Sn: 0 to 0.0500%]

Sn (tin) is an element inhibiting an anodic dissolution reaction and thereby contributing to improvement of the corrosion resistance of steel. On the other hand, Sn is an element causing a fall in the chemical convertibility. In the present invention, it is important to strictly manage the Sn content in the steel obtained after rolling. To secure sufficient chemical convertibility, the Sn content is 0.0500% or less, preferably 0.0300% or less, more preferably 0.0200% or less, still more preferably 0.0100% or less. From the viewpoint of improving the chemical convertibility further, the lower limit of the Sn content may also be 0%. On the other hand, Sn has the effect of improvement of the corrosion resistance even if just contained in an extremely small amount in the steel, therefore to improve the corrosion resistance, in particular, the end-face corrosion resistance, of the steel, the Sn content may also be 0.0001% or more, 0.0005% or more, 0.0010% or more, or 0.0050% or more.

[Sb: 0 to 0.0300% (Shared in Common in Embodiments 1 and 2)]

Sb (antimony) easily segregates at the surface of the steel and inhibits adsorption of oxygen gas, etc., from the outside to thereby be able to inhibit oxidation of Si. Due to this, the chemical convertibility is improved. The Sb content may be 0%, but the element may be included in accordance with need to obtain the above effect. The Sb content may also be 0.0005% or more, 0.0007% or more, or 0.0010% or more. On the other hand, from the viewpoint of securing sufficient workability, the Sb content is preferably 0.0300% or less and may also be 0.0250% or less, 0.0200% or less, or 0.0100% or less.

[V: 0 to 0.50% (Shared in Common in Embodiments 1 and 2)]

V (vanadium) is an element forming VC and contributing to improvement of the strength. The V content may be 0%, but the element may be included in accordance with need to obtain the above effect. The V content may also be 0.001% or more, 0.005% or more, or 0.01% or more. On the other hand, from the viewpoint of securing sufficient toughness and weldability, the V content is preferably 0.50% or less and may also be 0.30% or less, 0.10% or less, or 0.05% or less.

[W: 0 to 0.50% (Shared in Common in Embodiments 1 and 2)]

W (tungsten) is an element effective for improving the strength of steel. The W content may be 0%, but the element may be included in accordance with need to obtain the above effect. The W content may also be 0.001% or more, 0.005% or more, or 0.01% or more. On the other hand, from the viewpoint of inhibiting a decline in the toughness and the weldability, the W content is preferably 0.50% or less and may also be 0.30% or less, 0.10% or less, or 0.05% or less.

[Ca: 0 to 0.0100% (Shared in Common in Embodiments 1 and 2)]

Ca (calcium) is an element contributing to inclusion control, in particular fine dispersion of inclusions, and has an action of raising the toughness. The Ca content may be 0%, but the element may be included in accordance with need to obtain the above effect. The Ca content may also be 0.0005% or more, 0.0010% or more, or 0.0030% or more. On the other hand, even if excessively contained, the effect becomes saturated and a rise in the production costs is invited. Therefore, the Ca content is preferably 0.0100% or less and may be 0.0090% or less, 0.0080% or less, or 0.0060% or less.

[REM: 0 to 0.0100% (Shared in Common in Embodiments 1 and 2)]

REM (rare earth metals) are elements contributing to inclusion control, in particular fine dispersion of inclusions, and have an action of raising the toughness. The REM content may be 0%, but the element may be included in accordance with need to obtain the above effect. The REM content may also be 0.0005% or more, 0.0010% or more, or 0.0020% or more. On the other hand, even if excessively contained, the effect becomes saturated and a rise in the production costs is invited. Therefore, the REM content is preferably 0.0100% or less and may also be 0.0080% or less, 0.0060% or less, or 0.0040% or less.

In the cold rolled steel sheet according to the Embodiment 1, the balance aside from the above chemical composition consists of Fe and impurities. Here, "impurities" are constituents mixed in due to various factors in the production process, such as the ore, scrap, and other such raw materials when industrially producing cold rolled steel sheet.

[Other Elements (Shared in Common in Embodiments 1 and 2)]

In addition to the above-mentioned elements, instead of part of the above balance of Fe, one or more of Mg: 0 to 0.0100%, Hf: 0 to 0.0100%, Ta: 0 to 0.50%, and Zr: 0 to 0.0100% may also be contained. These elements may respectively be 0.0001% or more or 0.001% or more. Further, even if these elements are contained as impurities, the effect of the present invention is not impaired.

In the present invention, the chemical composition of the cold rolled steel sheet is analyzed by inductively coupled plasma mass spectrometry (ICP-MS method). However, for the C and S, the combustion-infrared absorption method is used for measurement, while for the N, the inert gas fusion-thermal conductivity method is used. These analyses are performed by samples of the steel sheet taken by the method based on JIS G0417: 1999.

[Formula (1'): $0.0001 \leq [Sn]+0.3[Cu]+0.1[Cr] \leq 0.0500$]

In the cold rolled steel sheet according to the Embodiment 1, to secure sufficient end-face corrosion resistance, the value found by [Sn]+0.3[Cu]+0.1[Cr] in the above formula (1') (also called "Formula (A)", where [Sn], [Cu] and [Cr] are respectively the contents (mass %) of Sn, Cu, and Cr) is 0.0001% or more. From the viewpoint of improvement of the end-face corrosion resistance, this value is preferably 0.0003% or more, more preferably 0.0005% or more, still more preferably 0.0010% or more and may also be 0.0030% or more, 0.0050% or more, or 0.0075% or more. Therefore, the cold rolled steel sheet contains inside it at least one of Sn, Cu, and Cr. If none of these is contained (if none is detected), i.e., the value found by the above formula (A) is 0, the end-face corrosion resistance becomes insufficient. On the other hand, to obtain cold rolled steel sheet excellent in chemical convertibility, the value found by the above formula (A) is 0.0500% or less. From the viewpoint of improvement of the chemical convertibility, that value is preferably 0.0400% or less, more preferably 0.0350% or less or 0.0300% or less, still more preferably 0.0200% or less or 0.0150% or less, most preferably 0.0120% or less or 0.0100% or less.

[Thickness of Oxide Film: 50 nm or Less (Shared in Common in Embodiments 1 and 2)]

If the oxide film formed on the steel sheet surface becomes too thick, a fall in the chemical convertibility is liable to be invited. Therefore, in the present embodiment, the thickness of the oxide film is 50 nm or less. The thickness of the oxide film may also be, for example, 40 nm or less, 30 nm or less, or 20 nm or less. The lower limit of the thickness of the oxide film is not particularly prescribed, but, for example, the thickness of the oxide film may also be 1 nm or more, 5 nm or more, or 10 nm or more. The thickness of the oxide film is determined by measuring the distribution of elements in the depth direction from the steel sheet surface using high frequency GDS (glow discharge spectrometry). More specifically, a sample is measured for a certain time by high frequency GDS, the obtained emission intensity of Fe is converted to the Fe concentration, and the thickness until that Fe concentration increases from a lower concentration to ½ of the Fe concentration of the base material is determined as the thickness of the oxide film. Here, the Fe concentration is quantified using reference samples of known concentrations. The thickness of the oxide film is calculated by measuring the sputter depth for a certain time period by a laser microscope and converting the sputter time until becoming ½ of the Fe concentration of the base material to thickness.

[Composition of Oxide Film (Shared in Common in Embodiments 1 and 2)]

In the present embodiment, it is necessary to satisfy the following formulas (2) and (3) when measuring the oxide film by the FT-IR reflectance method:

$$A/C < 0.30 \quad (2)$$

$$B/C < 3.0 \quad (3)$$

where A is an area of a peak derived from $SiO_2$, B is an area of a peak derived from $MnSiO_3$, and C is an area of a peak derived from $Mn_2SiO_4$.

As stated earlier, if expressing the $SiO_2$, $MnSiO_3$, and $Mn_2SiO_4$ forming the oxide film by the general formula $nMnO \cdot SiO_2$, they can respectively be expressed as follows:

$$SiO_2 = 0MnO \cdot SiO_2\ (n = 0)\quad MnSiO_3 = 1MnO \cdot SiO_2\ (n = 1)$$

$$Mn_2SiO_4 = 2MnO \cdot SiO_2\ (n = 2)$$

where, if the value of A/C (area of a peak derived from $SiO_2$/area of a peak derived from $Mn_2SiO_4$) and/or B/C (area of a peak derived from $MnSiO_3$/area of a peak derived from $Mn_2SiO_4$) becomes larger, it means the oxide film has a composition with a relatively large ratio of Si-rich oxides of $SiO_2$ and/or $MnSiO_3$ compared with the Mn-rich oxides of $Mn_2SiO_4$. If Si-rich oxides are present in a relatively large amount on the surface, the chemical convertibility of the steel sheet is liable to end up falling. For this reason, in the present embodiment, it is possible to remarkably improve the chemical convertibility of the steel sheet by controlling the A/C to less than 0.30 and, further, controlling the B/C to less than 3.0 so as to render the composition of the oxide film more Mn-rich oxides.

From the viewpoint of improvement of the chemical convertibility, A/C, for example, may be 0.25 or less, 0.23 or less, 0.20 or less, or 0.15 or less. Similarly, B/C, for example, may be 2.9 or less, 2.8 or less, 2.5 or less, 2.0 or less, or 1.5 or less. The lower limit of A/C is not particularly prescribed, but, for example, A/C may be 0.01 or more or 0.02 or more. Similarly, the lower limit of B/C is not particularly prescribed, but, for example, B/C may be 0.05 or more, 0.1 or more, or 0.3 or more.

[Method of Determination of A/C and B/C]

In the present embodiment, the values of A/C and B/C are determined in the following way. First, a sample including the steel sheet surface is measured by the FT-IR reflectance method, specifically Fourier transform infrared spectroscopy utilizing a high sensitivity reflectance method (RAS method), under conditions of measurement dimensions of 10 mm square and cumulative measurement of 200 times. At that time, to enlarge the light path length in the oxide film, the incident angle is shallow. For example, the measurement is preferably performed by a 5 to 20° incident angle. Next, in the infrared absorption spectrum having an abscissa of the wave number ($cm^{-1}$) and an ordinate of the transmittance (%), the values of the transmittances at the peaks derived from the oxides of $SiO_2$, $MnSiO_3$, and $Mn_2SiO_4$ are integrated and the values of A (area of a peak derived from $SiO_2$), B (area of a peak derived from $MnSiO_3$), and C (area of a peak derived from $Mn_2SiO_4$) are calculated from the obtained areas (integrated intensities). Here, the peak derived from $SiO_2$ is detected near 1250 $cm^{-1}$, the peak derived from $MnSiO_3$ is detected near 1050 $cm^{-1}$, and the peak derived from $Mn_2SiO_4$ is detected near 920 $cm^{-1}$. The peaks derived from $Mn_2SiO_4$ are detected not only near 920 $cm^{-1}$, but also near 1000 $cm^{-1}$, but the latter peak sometimes partially overlap the peak near 1050 $cm^{-1}$ derived from $MnSiO_3$. For this reason, the peak area relating to $Mn_2SiO_4$ is calculated based on only the peak near 920 $cm^{-1}$. Further, the peak near 1050 $cm^{-1}$ derived from $MnSiO_3$, as explained above, sometimes partially overlap the peak near 1000 $cm^{-1}$ derived from $Mn_2SiO_4$, therefore in such a case, the peak area derived from $MnSiO_3$ is calculated using a technique of peak separation by a computer. Finally, the values of A/C and B/C are determined from the calculated peak areas of A, B, and C.

According to the present embodiment, by strictly controlling the contents of Sn, Cu, and Cr in the above way and controlling the composition of the oxide film formed on the steel sheet surface within a predetermined range, more specifically controlling it to become not comprised of Si-rich oxides, but Mn-rich oxides, it is possible to obtain high strength cold rolled sheet maintaining sufficient corrosion resistance, in particular end-face corrosion resistance, while being excellent in chemical convertibility. Therefore, the cold rolled steel sheet can be directly treated for chemical conversion after cold rolling or after annealing, therefore the cold rolled steel sheet according to the present embodiment has the advantage that pickling, plating, etc., are not necessarily required as pretreatment for chemical conversion. Accordingly, the cold rolled steel sheet according to the present embodiment may also not have a plating layer containing at least one of Ni, Zn, and Co and having a balance of Fe and impurities (for example, an Ni flash plating layer) which is sometimes formed for the purpose of improving the chemical convertibility. As the facility for producing high strength cold rolled steel sheet, in general one having facilities for pickling after annealing or for plating by Ni, Zn, etc., would be possible, but provision of such facilities would require that much more capital investment and would require management of the fluctuating costs of acids and plating. As opposed to this, the cold rolled steel sheet according to the present embodiment can achieve good chemical conversion treatment even without having such facilities. Therefore, it is extremely advantageous from the viewpoint of cutting costs.

The cold rolled steel sheet according to the present embodiment is high in strength and has sufficient end-face corrosion resistance while being excellent in chemical convertibility, therefore can be optimally used in a broad range of fields such as automobiles, household electric appliances, and building materials, but is particularly preferably used in the automotive field. The cold rolled steel sheet for automotive use is usually treated for chemical conversion as pretreatment for coating. Therefore, if using the cold rolled steel sheet according to the present embodiment as cold rolled steel sheet for automotive use, it becomes possible to sufficiently maintain the end-face corrosion resistance while directly treating the cold rolled steel sheet for chemical conversion. The advantageous effect is exhibited well compared with the prior art.

[Tensile Strength (Shared in Common in Embodiments 1 and 2)]

In general, steel sheet having a high strength contains Si and Mn, but it is known that in such steel sheet, a film comprised of oxides of these is formed on the steel sheet surface whereby the chemical convertibility sometimes falls. Therefore, along with the increasing strength of steel sheet, it is tending to become difficult to secure the chemical convertibility of the steel sheet itself. Regarding this point, according to the present embodiment, as explained above, by strictly controlling the contents of the elements having an effect on the chemical convertibility and controlling the composition of the oxide film formed on the steel sheet surface within a predetermined range, it becomes possible to secure sufficient chemical convertibility even in steel sheet having a high strength. The tensile strength of the thin steel sheet according to the present invention, in particular, the cold rolled steel sheet according to the Embodiment 1 and the hot rolled steel sheet according to the Embodiment 2 explained later, is 340 MPa or more, for example, may be 400 Mpa or more, 440 Mpa or more, 500 Mpa or more, 600 Mpa or more, 700 Mpa or more, or 800 Mpa or more. The upper limit of the tensile strength is not particularly limited, but from the viewpoint of securing toughness, for example, it may be 2000 Mpa or less. In this Description, "high strength" means the tensile strength is 340 Mpa or more. The tensile strength is determined by taking a No. 5 tensile test piece of JIS Z 2241: 2011 having a direction perpendicular to the rolling direction as its longitudinal direction and performing a tensile test based on JIS Z 2241: 2011.

[Method of Production of Cold Rolled Steel Sheet According to Embodiment 1]

An example of the method of production of the cold rolled steel sheet according to the Embodiment 1 will be explained next. The following explanation is intended to illustrate the characterizing method for producing the cold rolled steel sheet according to the Embodiment 1 and is not intended to limit the cold rolled steel sheet to one produced by the method of production explained below.

The method of production of the cold rolled steel sheet according to the present embodiment includes a casting step for casting molten steel adjusted in chemical composition to give cold rolled steel sheet having a desired chemical composition and thereby form a steel slab, a hot rolling step for hot rolling the steel slab to obtain hot rolled steel sheet, a cooling step, a coiling step for coiling the hot rolled steel sheet, a pickling step, and a cold rolling step for cold rolling the hot rolled steel sheet to obtain cold rolled steel sheet. Further, it is also possible to perform an annealing step for annealing the cold rolled steel sheet after the cold rolling step under any conditions.

[Casting Step (Shared in Common in Embodiments 1 and 2, However, in Embodiment 2, Read Formula (1') as Formula (1))]

The conditions of the casting step are not particularly limited. For example, after melting by a blast furnace, electric furnace, etc., various secondary refining operations may be performed, then casting may be performed by the usual continuous casting, casting by the ingot method, thin slab casting, or other method. Scrap can also be used for the raw material, but the amount of scrap used is adjusted so that the contents of the elements of the obtained cold rolled steel sheet satisfy the above ranges and Formula (1') is satisfied.

[Hot Rolling Step (Shared in Common in Embodiments 1 and 2)]

The steel slab cast in the above way can be hot rolled to obtain hot rolled steel sheet. The hot rolling step is performed by directly hot rolling the cast steel slab or cooling it once, then reheating it. If reheating it, the heating temperature of the steel slab may be, for example, 1000° C. to 1300° C. In the hot rolling step, usually rough rolling and finish rolling are performed. The temperatures and rolling reductions of the rolling operations may be suitably determined in accordance with the desired metallic structures and sheet thicknesses. For example, the end temperature of the finish rolling may be 900 to 1000° C. and the rolling reduction of the finish rolling may be 10 to 50%. As the lubrication oil of the hot rolling rolls, for example, lubrication oil containing a basic organic metal salt, specifically high basicity Ca sulfonate-containing lubrication oil (content 20 to 50 mass %), is preferably used.

[Cooling Step (Shared in Common in Embodiments 1 and 2)]

At the stage after hot rolling where an oxide film is formed, Sn, Cu, Cr, and other elements tend to easily concentrate at the steel sheet surface. For this reason, by cooling by a relatively fast speed after hot rolling so as to inhibit surface concentration of these elements, it is possible to make the composition of the oxide film formed at the steel sheet surface not Si-rich oxides, but more Mn-rich oxides. As a result, it becomes possible to achieve excellent chemical convertibility in the finally obtained product (thin steel sheet). In the method of production according to the present embodiment, it is necessary to cool the sheet down to a 650° C. or less cooling stop temperature by a 50 to 300° C./s average cooling speed after the finish rolling in the hot rolling step. Further, by performing such rapid cooling, it becomes possible to make the thickness of the scale formed thinner.

[Coiling Step (Shared in Common in Embodiments 1 and 2)]

After the cooling step, the hot rolled steel sheet can be coiled at a 650° C. or less predetermined temperature. The coiling temperature may be suitably determined in accordance with the desired metallic structure, etc. For example, it may be determined from a range of 450 to 650° C.

[Pickling Step (Shared in Common in Embodiments 1 and 2)]

Even with a previous cooling step, sometimes surface concentration of Sn, Cu, Cr, and other elements cannot be sufficiently inhibited. In such a case, the composition of the oxide film formed on the steel sheet surface becomes relatively Si-rich oxides and the chemical convertibility of the steel sheet falls. Therefore, after the coiling step, in the pickling step, it is necessary to perform relatively strong pickling treatment to thereby remove scale and reliably eliminate the surface concentrated layer containing Sn, Cu, Cr, and other elements. Specifically, by performing a first pickling by hydrochloric acid at an acid concentration of 7 to 10%, a pickling temperature of 80 to 95° C., and a pickling time of 30 to 100 seconds, then performing a second pickling by sulfuric acid at an acid concentration of 10 to 18%, a pickling temperature of 80 to 95° C., and a pickling time of 30 to 100 seconds, it is possible to remove the surface concentrated layer containing Sn, Cu, Cr, and other elements. However, even if performing such strong pickling treatment, if not sufficiently inhibiting surface concentration of the above elements in the cooling step, it is difficult to reliably remove the surface concentrated layer by just such pickling treatment. Therefore, in the method of production of the present embodiment, the combination of rapid cooling at the cooling step and strong pickling at the pickling step is important.

[Cold Rolling Step]

After the pickling step, the hot rolled steel sheet can be cold rolled to obtain cold rolled steel sheet. The rolling reduction of the cold rolling may be suitably determined in accordance with the desired metallic structure and sheet thickness. For example, it may be determined from a range of 30 to 80%.

[Annealing Step]

As an option, the cold rolled steel sheet obtained after the cold rolling step may also be annealed. The annealing conditions may be suitably determined, but, for example, may be an annealing temperature of 730 to 850° C. and a holding time of 30 to 200 seconds. Further, the atmosphere at the time of annealing may be, for example, a 1 to 10% hydrogen concentration and a −60 to −20° C. dew point.

The cold rolled steel sheet according to the Embodiment 1 obtained by the above method of production, as explained above, can satisfy the Formula (1') and control the oxide film of the steel sheet surface to 50 nm or less while having a composition comprised of Mn-rich oxides, therefore even if the surface of the steel sheet does not have a plating layer containing at least one of Ni, Zn, and Co and having a balance of Fe and impurities present on it, if directly treating the steel sheet for chemical conversion, it becomes possible to sufficiently form chemical conversion crystals on the steel sheet surface. Accordingly, the method of production of the cold rolled steel sheet according to the Embodiment 1 need not include formation of a plating layer containing at least one of Ni, Zn, and Co on the cold rolled steel sheet after the cold rolling step or after the annealing step.

Embodiment 2

The thin steel sheet according to the Embodiment 2 of the present invention is a hot rolled steel sheet having a chemical composition comprising, by mass %, C: 0.050 to 0.300%,
Si: 0.10 to 4.00%,
Mn: 0.80 to 6.00%,
Al: 0.010 to 2.000%,
P: 0 to 0.100%,
S: 0 to 0.100%,
N: 0 to 0.0300%,
Ni: 0 to 0.05%,
Cu: 0 to 0.50%,
Cr: 0 to 1.00%,
Mo: 0 to 0.50%,
Ti: 0 to 0.200%,
Nb: 0 to 0.100%,
B: 0 to 0.0200%,
Sn: 0 to 0.2000%,
Sb: 0 to 0.0300%,
V: 0 to 0.50%,
W: 0 to 0.50%,
Ca: 0 to 0.0100%,
REM: 0 to 0.0100%, and
balance: Fe and impurities, and satisfying the following formula (1), and
an oxide film having a thickness of 50 nm or less on its surface, and satisfying the following formulas (2) and (3) when measuring the oxide film by an FT-IR reflectance method:

$$0.0001 \leq [Sn] + 0.3[Cu] + 0.1[Cr] \leq 0.2000 \quad (1)$$

where [Sn], [Cu] and [Cr] respectively are the contents (mass %) of Sn, Cu, and C.

$$A/C < 0.30 \quad (2)$$

$$B/C < 3.0 \quad (3)$$

where A is an area of a peak derived from $SiO_2$, B is an area of a peak derived from $MnSiO_3$, and C is an area of a peak derived from $Mn_2$ $SiO_4$.

A hot rolled steel sheet having a high strength (tensile strength of 340 MPa or more) for automotive use is desired to have excellent chemical convertibility. The chemical conversion treatment for example [1] is sometimes performed on a plating layer provided on the hot rolled steel sheet and containing Ni, Zn, Co, etc., and [2] is sometimes performed directly on the hot rolled steel sheet after pickling for removing the scale. In the case of [1], usually, after removing the scale by pickling, the hot rolled steel sheet is further treated by pickling as pretreatment for plating, then the hot rolled steel sheet is formed with a plating layer excellent in chemical convertibility (for example, an Ni plating or a small plating thickness Ni flash plating layer or Zn plating layer) and then is treated for chemical conversion on top of that. In this case, due to the presence of the plating layer, even if the hot rolled steel sheet itself is not sufficient in chemical convertibility, the hot rolled steel sheet having that plating layer has sufficient chemical convertibility, therefore good chemical conversion treatment can be applied. For this reason, the effect of the chemical composition of the steel sheet on the chemical conversion treatment is not necessarily great.

However, among the facilities used for producing a high strength steel sheet, there are many facilities which are unable to perform either or both of the pickling treatment and plating treatment. In such a case, i.e., in the case of [2], for example, after removal of scale by pickling, the hot rolled steel sheet is for example directly treated for chemical conversion after degreasing or other cleaning steps. In this case, there is no plating layer present on the hot rolled steel sheet, therefore if the steel sheet itself is not sufficient in chemical convertibility, the chemical conversion treatment is liable to not be performed well. For this reason, the chemical composition and surface conditions of the steel sheet will have an extremely great effect on the chemical conversion treatment.

First, the inventors analyzed in detail the relationship between the chemical composition of steel sheet and chemical convertibility so as to obtain a hot rolled steel sheet excellent in chemical convertibility enabling excellent chemical conversion even when not providing a plating layer, etc., on the steel sheet. As a result, the inventors discovered that among the constituents contained in steel sheet, Sn, Cu, and Cr cause the chemical convertibility to fall. Further, the inventors analyzed in detail the degrees of effects of these elements on the chemical convertibility and as a result discovered that the degrees of effect, i.e., the degrees of effect of causing the chemical convertibility to fall, are Sn>Cu>Cr. More specifically, they discovered that the value found by the following formula (A) can be used to express well the relationship between the "contents (mass %) of Sn, Cu, and Cr" and the "chemical convertibility" and that when a hot rolled steel sheet is directly chemically converted (case of above [2]), to ensure sufficient chemical convertibility, the value found by the following formula (A) has to be 0.2000% or less:

$$[Sn] + 0.3[Cu] + 0.1[Cr] \quad (A)$$

where [Sn], [Cu] and [Cr] respectively are the contents (mass %) of Sn, Cu, and Cr, when not contained (when not measured by analysis), 0 being entered.

On the other hand, in the high strength hot rolled steel sheet for automotive use, household electric appliances, building materials, etc., usually having a high corrosion resistance is sought. More specifically, in the hot rolled steel sheet for automotive use, etc., both flat surface corrosion resistance and end-face corrosion resistance are demanded. "Flat surface corrosion resistance" is the corrosion resistance at the flat surface part (surface part) of steel sheet. This can be secured by the presence of a coating film formed by coating the steel sheet surface. On the other hand, the "end-face corrosion resistance" means the corrosion resistance of the end face parts when coated by electrodeposition after the steel sheet is cut. As explained previously, at the projecting parts of the end faces, the electrodeposition coating becomes thinner, therefore the end face parts easily become starting points of corrosion.

In relation to this, the elements Sn, Cu, and Cr contained in the above formula (A) are known to be elements contributing to improvement of the corrosion resistance of the steel itself. Therefore, the inventors analyzed the relationship between the "contents (mass %) of Sn, Cu, and Cr" and the "end-face corrosion resistance" and as a result discovered that in order for the steel to maintain sufficient end-face corrosion resistance, the value found by the above (A) has to be 0.0001% or more.

As explained above, to obtain a high strength hot rolled steel sheet maintaining end-face corrosion resistance while having improved chemical convertibility, it is extremely important to control the contents of Sn, Cu, and Cr in the hot rolled steel sheet, more specifically control the value found by Formula (A) to 0.0001% or more and 0.2000% or less, i.e., within a range satisfying the following formula (1):

$$0.0001 \leq [Sn] + 0.3[Cu] + 0.1[Cr] \leq 0.2000 \quad (1)$$

The contents of the elements contained in the hot rolled steel sheet are determined in large part by adjusting the chemical composition of the molten steel when producing the slab to be used for the hot rolling step. However, the hot rolled steel sheet obtained by hot rolling the above slab can also contain elements other than the elements intentionally added when adjusting the chemical composition of the molten steel. For example, in the production of steel sheet, in general, scrap is often used from the viewpoint of reducing the production costs. The elements mixed in the scrap will possibly be contained in the finally obtained cold rolled steel sheet. The above-mentioned Sn, Cu, and Cr are all known to be elements possibly contained in scrap. Therefore, these elements are sometimes contained in the finally obtained cold rolled steel sheet even if not intentionally added into the steel. In particular, the above elements are not completely removed in the process of melting and refining by an electric furnace. Therefore, these elements are present in the scrap and as a result are contained in the final product. Further, Sn, Cu, and Cr are sometimes unavoidably contained in production in addition to being contained in the scrap.

Therefore, to obtain a hot rolled steel sheet excellent in end-face corrosion resistance and chemical convertibility, in particular, chemical convertibility, it is important to consider the amounts of Sn, Cu, and Cr finally contained in the hot rolled steel sheet due to use of scrap, etc., so as to suitably and strictly control the chemical composition of the finally obtained hot rolled steel sheet. For example, if the above elements are not intentionally added, it is possible to sufficiently manage the elements contained in the scrap, manage the ratio of the scrap used for production, etc., so as to manage and control the chemical composition of the hot rolled steel sheet.

Furthermore, the inventors studied in detail the relationship between the surface conditions of the steel sheet and the chemical convertibility. As a result, the inventors discovered that by just controlling the chemical composition of the steel sheet so that the above formula (A) becomes 0.2000% or less, the improvement of the chemical convertibility is not necessarily sufficient and, in addition to this, that the composition of the oxide film formed on the steel sheet surface has to be controlled within a predetermined range. More specifically, the inventors discovered that to improve the chemical convertibility of the steel sheet, it is necessary to control the oxide film of the steel sheet surface to 50 nm or less while satisfying the following formulas (2) and (3) when measuring the oxide film by the FT-IR reflectance method.

$$A/C < 0.30 \quad (2)$$

$$B/C < 3.0 \quad (3)$$

where A is an area of a peak derived from $SiO_2$, B is an area of a peak derived from $MnSiO_3$, and C is an area of a peak derived from $Mn_2\ SiO_4$.

In the present embodiment, due to reasons the same as explained in relation to the Embodiment 1, the thickness of the oxide film able to act disadvantageously against chemical convertibility is kept within a predetermined range while A/C and B/C are controlled within the range shown in the above formulas (2) and (3) to make the composition of the oxide film not Si-rich oxides able to act disadvantageously to chemical convertibility in the same way, but more Mn-rich oxides. As a result, according to the present embodiment, as shown in the above formula (1), by controlling the amounts of Sn, Cu, and Cr in the steel sheet within predetermined ranges while making the composition of the oxide film formed on the steel sheet surface due to the Si or Mn generally added in high strength steel sheet a suitable one, it becomes possible to obtain high strength hot rolled steel sheet maintaining sufficient end-face corrosion resistance while being excellent in chemical convertibility. Below, the component elements of the hot rolled steel sheet according to the Embodiment 2 will be explained in detail.

[Hot Rolled Steel Sheet]

The thickness of the hot rolled steel sheet according to the Embodiment 2 is not particularly limited, but, for example, may be 1.0 to 4.0 mm. The sheet thickness may be 1.2 mm or more or 2.0 mm or more and/or may be 3.5 mm or less or 3.2 mm or less.

[Chemical Composition]

The chemical composition contained in the hot rolled steel sheet according to the present embodiment will be explained next. The "%" relating to the contents of the elements, unless particularly indicated otherwise, means "mass %". Further, the numerical values shown below are values obtained by analyzing hot rolled steel sheet by inductively coupled plasma mass spectrometry (ICP-MS method), etc. Therefore, in this Description, "chemical composition" includes not only constituents derived from elements intentionally added at the time of production, but also constituents unavoidably mixed into the steel at the time of production of the hot rolled steel sheet (for example, constituents derived from elements which had been contained in the scrap). In the numeral ranges in the chemical composition, numerical ranges expressed using "to", unless particularly indicated otherwise, mean ranges including the numerical values described before and after the "to" as the lower limit values and upper limit values.

The basic chemical composition of C, Si, Mn, Al, P, S, and N relating to the hot rolled steel sheet according to the Embodiment 2 are as explained in relation to the cold rolled steel sheet according to the Embodiment 1. Furthermore, the hot rolled steel sheet may also contain the following optional elements according to need. Inclusion of these elements is not essential. The lower limits of the contents of these elements are 0%.

[Cu: 0 to 0.500%]

Cu (copper) is an element contributing to improvement of the strength or corrosion resistance of the steel. On the other hand, as explained above, Cu is an element causing a fall in chemical convertibility second to Sn. In the present invention, it is important to strictly manage the Cu content in the steel obtained after rolling. To secure sufficient chemical convertibility, the Cu content is 0.500% or less, preferably 0.300% or less, more preferably 0.200% or less. From the viewpoint of further improving the chemical convertibility, the lower limit of the Cu content may also be 0%. On the other hand, to improve the corrosion resistance of steel, in particular the end-face corrosion resistance, the Cu content may also be for example 0.010% or more, 0.050% or more, 0.100% or more, or 0.150% or more.

[Cr: 0 to 1.00%]

Cr (chromium) is an element contributing to improvement of the strength or corrosion resistance of the steel. On the other hand, as explained above, Cr is an element causing a fall in chemical convertibility second to Sn and Cu. In the present invention, it is important to strictly manage the Cr content in the steel obtained after rolling. To secure sufficient chemical convertibility, the Cr content is 1.00% or less, preferably 0.80% or less, more preferably 0.50% or less, still more preferably 0.30% or less. From the viewpoint of further improving the chemical convertibility, the lower limit of the Cr content may also be 0%. On the other hand, to improve the corrosion resistance of steel, in particular the end-face corrosion resistance, the Cr content may also be for example 0.01% or more, 0.02% or more, 0.03% or more, 0.05% or more, or 0.10% or more.

[Sn: 0 to 0.2000%]

Sn (tin) is an element inhibiting an anodic dissolution reaction and thereby contributing to improvement of the corrosion resistance of steel. On the other hand, Sn is an element causing a fall in the chemical convertibility. In the present invention, it is important to strictly manage the Sn content in the steel obtained after rolling. To secure sufficient chemical convertibility, the Sn content is 0.2000% or less, preferably 0.1500% or less, more preferably 0.1000% or less, still more preferably 0.0500% or less. From the viewpoint of improving the chemical convertibility further, the lower limit of the Sn content may also be 0%. On the other hand, Sn has the effect of improvement of the corrosion resistance even if just contained in an extremely small amount in the steel, therefore to improve the corrosion resistance, in particular, the end-face corrosion resistance, of the steel, the Sn content may also be 0.0001% or more, 0.0005% or more, 0.0010% or more, or 0.0020% or more.

The other optional elements which can be contained in the hot rolled steel sheet according to the Embodiment 2, i.e., Ni, Mo, Ti, Nb, B, Sb, V, W, Ca. and REM and, similarly, other elements which can be contained in the hot rolled steel sheet according to the Embodiment 2, i.e., Mg, Hf, Ta, and Zr, are as explained in relation to the cold rolled steel sheet according to the Embodiment 1.

In the hot rolled steel sheet according to the Embodiment 2, the balance other than the above elements consists of Fe and impurities. Here, "impurities" are constituents mixed in due to various factors in the production process, such as the ore, scrap, and other such raw materials when industrially producing hot rolled steel sheet.

In the present invention, the chemical composition of the hot rolled steel sheet is analyzed by inductively coupled mass spectrometry (ICP-MS method). However, for C and S, the combustion-infrared absorption method is used for the measurement, while for the N, the inert gas fusion-thermal conductivity method is used. These analyses are performed by samples obtained by the method based on JIS G0417: 1999.

[Formula (1): $0.0001 \leq [Sn]+0.3[Cu]+0.1[Cr] \leq 0.2000$]

In the hot rolled steel sheet according to the Embodiment 2, to secure sufficient end-face corrosion resistance, the value found by [Sn]+0.3[Cu]+0.1[Cr] in the above formula (1) (also referred to as the Formula (A), [Sn], [Cu], and [Cr] respectively being the Sn, Cu, and Cr of the contents (mass %)) is 0.0001% or more. From the viewpoint of improvement of the end-face corrosion resistance, the value is preferably 0.0005% or more, more preferably 0.0010% or more, still more preferably 0.0030% or more, or 0.0050% or more, further more preferably 0.0075% or more, or 0.0100% or more. Therefore, the hot rolled steel sheet contains at least one of Sn, Cu, and Cr. If none of these are contained (if none are detected), i.e., if the value found by the above formula (A) is 0, the end-face corrosion resistance is insufficient. On the other hand, to obtain hot rolled steel sheet excellent in chemical convertibility, the value found by the above formula (A) is 0.2000% or less. From the viewpoint of improvement of the chemical convertibility, the value is preferably 0.1500% or less, more preferably 0.1000% or less, still more preferably 0.0500% or less, or 0.0400% or less, most preferably 0.0300% or less and may be 0.0200% or less, 0.0150% or less, or 0.0120% or less.

The thickness of the oxide film, the composition of the oxide film, the methods of determining the same, and the tensile strength in the hot rolled steel sheet according to the Embodiment 2 are as explained above in relation to the cold rolled steel sheet according to the Embodiment 1.

According to the present embodiment, in the above way, by strictly controlling the contents of Sn, Cu, and Cr and controlling the composition of the oxide film formed on the steel sheet surface within a predetermined range, more specifically controlling it to become not Si-rich oxides, but Mn-rich oxides, it is possible to obtain high strength hot rolled steel sheet maintaining sufficient corrosion resistance, in particular, end-face corrosion resistance, while being excellent in chemical convertibility. Therefore, it becomes possible to directly chemically convert the hot rolled steel sheet after descaling by pickling, therefore the hot rolled steel sheet according to the present embodiment has the advantage of pickling, plating, etc., not necessarily being required as pretreatment for chemical conversion treatment. Accordingly, the hot rolled steel sheet according to the present embodiment need not have a plating layer containing at least one of Ni, Zn, and Co and having a balance of Fe and impurities (for example, Ni flash plating layer) which is sometimes formed for the purpose of improving the chemical convertibility, etc. As a facilities or producing high strength hot rolled steel sheet, in general facilities for pickling or plating of Ni, Zn, etc., can be provided for pretreatment of plating, but provision of such facilities would require that much greater a capital investment and require management of the fluctuating costs of acids and plating. As opposed to this, the hot rolled steel sheet according to the present embodiment can be chemically converted well even without providing such facilities. Therefore, this is extremely advantageous from the viewpoint of cost cutting.

The hot rolled steel sheet according to the present embodiment is high in strength and maintains sufficient end-face corrosion resistance while being excellent in chemical convertibility, therefore can be suitably used in automobiles, household electric appliances, building materials, and other broad fields, but in particular is preferably used in the automotive field. Hot rolled steel sheet for automotive use is usually chemically converted as pretreatment for coating steel sheet. Therefore, if using the hot rolled steel sheet according to the present embodiment as hot rolled steel sheet for automobile use, it becomes possible to sufficiently maintain end-face corrosion resistance while directly chemically converting the hot rolled steel sheet after descaling by pickling and an effect advantageous over the prior art is suitably exhibited.

[Method of Production of Hot Rolled Steel Sheet According to Embodiment 2]

An example of the method of production of hot rolled steel sheet according to the Embodiment 2 will be explained next. The following explanation is intended to illustrate a characterizing method for producing the hot rolled steel sheet according to the Embodiment 2 and is not intended to limit the hot rolled steel sheet to one produced by the method of production such as explained below.

The method of production of the hot rolled steel sheet according to the present embodiment includes a casting step for casting molten steel adjusted in chemical composition to give hot rolled steel sheet having a desired chemical composition and thereby form a steel slab, a hot rolling step for hot rolling the steel slab to obtain hot rolled steel sheet, a cooling step, a coiling step for coiling the hot rolled steel sheet, and a pickling step. The method of production of hot rolled steel sheet according to the present embodiment is the same as the method of production of cold rolled steel sheet according to the Embodiment 1 except for casting the molten steel adjusted so as to satisfy Formula (1) in the production process and there being no step after the cold rolling step. That is, details of the casting step, hot rolling step, cooling step, coiling step, and pickling step according to the present embodiment (parts other than difference of Formula (1) and Formula (1')) are as explained above in relation to the cold rolled steel sheet according to the Embodiment 1.

The hot rolled steel sheet according to the Embodiment 2 obtained by the above method of production, as explained above, satisfies the Formula (1) and controls the oxide film of the steel sheet surface to 50 nm or less while rendering the composition Mn-rich oxides, therefore even if the surface of the steel sheet does not have a plating layer containing at least one type of Ni, Zn, and Co and having a balance of Fe and impurities present on it, it becomes possible to sufficiently form chemical conversion crystals on the steel sheet surface if directly chemically converting the steel sheet. Accordingly, in the production of the hot rolled steel sheet according to the Embodiment 2, after pickling, a plating layer containing at least one of Ni, Zn, and Co need not be formed on the hot rolled steel sheet.

Below, examples will be used to explain the present invention in more detail, but the present invention is not limited to these examples in any way.

EXAMPLES

In the following examples, the thin steel sheets according to the Embodiments 1 and 2 (respectively the cold rolled steel sheets and hot rolled steel sheets) were produced in Examples X and Y. The obtained thin steel sheets were investigated for tensile strength, chemical convertibility, and end-face corrosion resistance. The contents of the elements, oxide film, tensile strength, chemical convertibility, and end-face corrosion resistance in the thin steel sheets obtained in Examples X and Y were measured and evaluated by the following methods.

[Contents of Elements]

The contents of the elements contained in the samples obtained from the produced thin steel sheets were measured by the ICP-MS method. For the C and S, the combustion-infrared absorption method was used for the measurement, while for the N, the inert gas fusion-thermal conductivity method was used. For the measurement use samples, chips were obtained from samples by the method based on JIS G0417: 1999.

[Thickness and Composition of Oxide Film]

The thickness of the oxide film was determined by measuring the distribution of elements in the depth direction from the steel sheet surface using high frequency GDS. More specifically, a sample was measured by high frequency GDS in the constant power mode for 100 seconds, the obtained emission intensity of the Fe was converted to concentration, and the thickness at which the Fe concentration increased from a lower concentration and became ½ of the Fe concentration of the base material was determined as the thickness of the oxide film. Here, the Fe concentration was quantified using reference samples of known concentrations, and the thickness of the oxide film was calculated by measuring the sputter depth over 100 seconds by a laser microscope and converting the sputter time where the Fe concentration of the base material became ½ to thickness. Further, the values of A/C and B/C of the oxide film were determined as follows. First, a sample including the steel sheet surface obtained from each produced thin steel sheet was measured by the Fourier transform infrared spectroscopy utilizing a high sensitivity reflectance method (RAS method) under conditions of measurement dimensions of 10 mm square, an incident angle of 10°, and cumulative measurement of 200 times. Next, in the infrared absorption spectrum having an abscissa of the wave number ($cm^{-1}$) and an ordinate of the transmittance (%), the values of the transmittances at the peaks derived from the oxides of $SiO_2$, $MnSiO_3$, and $Mn_2SiO_4$ were integrated and the values of A (area of a peak derived from $SiO_2$), B (area of a peak derived from $MnSiO_3$), and C (area of a peak derived from $Mn_2SiO_4$) were calculated from the obtained areas (integrated intensities). Here, the area of the peak derived from $SiO_2$ was calculated by integrating the peak detected near 1250 $cm^{-1}$ and similarly the area of the peak derived from $MnSiO_3$ was calculated by integrating the peak detected near 1050 $cm^{-1}$ and the area of the peak derived from $Mn_2SiO_4$ was calculated by integrating the peak detected near 920 $cm^{-1}$. When the peak near 1050 $cm^{-1}$ derived from $MnSiO_3$ partially overlap the peak near 1000 $cm^{-1}$ derived from $Mn_2SiO_4$, the technique of peak separation using a computer was used to calculate the area of the peak derived from $MnSiO_3$. Finally, the values of A/C and B/C were determined from the peak areas of A, B, and C calculated.

[Tensile Strength]

The tensile strength is determined by taking a No. 5 tensile test piece of JIS Z 2241: 2011 having a direction perpendicular to the rolling direction as its longitudinal direction and performing a tensile test based on JIS Z 2241: 2011.

[Chemical Convertibility]

A sample obtained from each thin steel sheet produced was cut to 50 mm×100 mm. This was sprayed with a 1 liter aqueous solution of 18 g of a degreasing agent made by Nihon Parkerizing Co., Ltd. (product name: Fine Cleaner E2083) at 40° C. for 120 seconds to soak and degrease it.

After that, the surface was conditioned by a Ti-based colloid powder. The sample was dipped in a zinc phosphate treatment agent made by Nihon Parkerizing Co., Ltd. (product name: Palbond L3065) for 120 seconds, rinsed, and dried to thereby form a chemically converted film comprised of a zinc phosphate film on the surface of each sample.

Three locations along the length direction (center part and two end parts) of each test piece chemically converted in the above way were examined using a scan type electron microscope (SEM) by a 1500× magnification (examined area: about 80 μm×about 60 μm). Further, the average area ratio X of formation of the chemical conversion crystals with respect to the sample surface was calculated for each test sample based on the examined images of the three locations. More specifically, for each sample, at the respective examined images acquired at the three locations, the area ratios of the parts at which chemical conversion crystals are formed with respect to the area of the sample surface (=area of image) are found and these values were averaged to find the average area ratio X. Based on the found average area ratio X. the following criteria were used to evaluate the chemical convertibility (ratio of deposition of chemical conversion crystals on sample surface). "Good" and "fair" were judged as passing.

Evaluation: good: 99%<X≤100%

Evaluation: fair: 97%<X≤99%

Evaluation: poor: X≤97%

[End-Face Corrosion Resistance]

Samples cut to 50 mm×100 mm and chemically converted were coated by electrodeposition. The 100 mm side end faces evaluated at this time were all rendered upper burrs (burrs formed toward evaluation surface). The cationic electrodeposition coating Powernix 110 made by Nipponpaint Industrial Coatings Co., Ltd. was coated aiming at a film thickness of 15 μm and was baked at 170° C.×20 minutes. After that, the samples were used for corrosion tests without sealing the end faces. At that time, three samples were used for the corrosion tests. As the test for evaluation of the end-face corrosion resistance, a combined corrosion test based on the Japanese Automobile Standards Organization standard was performed (based on neutral salt spray cycle test of JIS H8502: 1999). This test was performed for a total of 180 cycles (total 60 days) comprised of a cycle of (1) salt water spraying for 2 hours (5% NaCl, 35° C.); (2) drying for 4 hours (60° C.); and (3) wetting for 2 hours (50° C., humidity 95% or more). After that, the end face parts were taped to peel off the coating film of the evaluation surface and the peeled width of the coating film was measured. The maximum value of the peeled width from the end faces was read and the average value of three samples was calculated. The end-face corrosion resistance was evaluated based on the found peeled width Y using the following criteria and "good" was deemed passing.

Evaluation: good: 3 mm≥Y

Evaluation: poor: 3 mm<Y

In the following Examples X and Y, the cases where the tensile strength is 340 MPa or more and the chemical convertibility and end-face corrosion resistance are evaluated as passing were evaluated as high strength thin steel sheet maintaining end-face corrosion resistance while having improved chemical convertibility.

[Example X (Corresponding to Embodiment 1): Production of Cold Rolled Steel Sheet]

First, molten steels suitably adjusted in chemical composition were cast to form steel slabs and the steel slabs were hot rolled as they were. Next, the finish rolled steel sheets were cooled under the cooling conditions shown in Table 1, coiled, then treated by predetermined pickling, specifically a first pickling by hydrochloric acid by an acid concentration of 9%, a pickling temperature of 90° C., and a pickling time of 60 seconds and a subsequent second pickling by sulfuric acid by an acid concentration of 15%, a pickling temperature of 90° C., and a pickling time of 60 seconds suitably combined for pickling treatment (for the specific combination of the first pickling and second pickling in each example, see Table 1). In all of the steel sheets, the end temperature of the finish rolling was 950° C., the rolling reduction of the finish rolling was 20%, and the coiling temperature was 600° C. Next, the pickled hot rolled steel sheets were cold rolled by rolling reductions of 50% to obtain thickness 1.2 mm cold rolled steel sheets. After that, the obtained cold rolled steel sheets were annealed at 800° C. for 60 seconds in an atmosphere of a hydrogen concentration of 2% and dew point of −30° C. None of the cold rolled steel sheets were plated, i.e., none of the cold rolled steel sheets had plating layers containing at least one of Ni, Zn, and Co. The chemical compositions measured for samples obtained from the steel sheets are shown in Table 1. The empty fields in Table 1 show the contents were the detection limits or less and show the elements were not contained in the samples (content 0%). Further, for each sample, the values related to Formula (1') were calculated based on the obtained values of the Sn content, Cu content, and Cr content.

TABLE 1-1

| Steel | Chemical composition (mass %), balance Fe and impurities | | | | | | | | | | | | | | | | Formula |
|---|---|---|---|---|---|---|---|---|---|---|---|---|---|---|---|---|---|
| no. | C | Si | Mn | Al | P | S | N | Ni | Cu | Cr | Mo | Ti | Nb | B | Sn | Others | (1') |
| 101 | 0.108 | 0.27 | 0.97 | 0.021 | 0.015 | 0.005 | 0.0031 | 0.03 | 0.04 | 0.08 | 0.01 | | | 0.0011 | 0.0100 | | 0.0300 |
| 102 | 0.082 | 0.36 | 1.69 | 0.033 | 0.017 | 0.005 | 0.0033 | 0.02 | 0.02 | 0.01 | 0.01 | | 0.020 | | 0.0050 | | 0.0120 |
| 103 | 0.090 | 0.44 | 2.46 | 0.024 | 0.011 | 0.003 | 0.0037 | 0.02 | 0.05 | 0.03 | 0.02 | 0.021 | | 0.0019 | 0.0100 | | 0.0280 |
| 104 | 0.082 | 0.43 | 2.19 | 0.024 | 0.011 | 0.002 | 0.0028 | 0.01 | 0.01 | 0.39 | | | 0.001 | | 0.0008 | | 0.0428 |
| 105 | 0.211 | 0.11 | 3.02 | 0.027 | 0.014 | 0.002 | 0.0025 | 0.01 | 0.01 | 0.02 | 0.01 | 0.024 | | 0.0021 | 0.0006 | | 0.0056 |
| 106 | 0.210 | 0.55 | 2.34 | 0.031 | 0.012 | 0.003 | 0.0033 | 0.02 | 0.02 | 0.03 | | 0.031 | | 0.0018 | 0.0005 | | 0.0095 |
| 107 | 0.134 | 0.51 | 2.71 | 0.030 | 0.015 | 0.004 | 0.0028 | 0.03 | 0.03 | 0.05 | | 0.025 | | | | | 0.0140 |
| 108 | 0.081 | 0.44 | 2.20 | 0.023 | 0.014 | 0.002 | 0.0025 | 0.01 | 0.01 | 0.50 | | | | | 0.0008 | | 0.0538 |
| 109 | 0.082 | 0.42 | 2.25 | 0.028 | 0.014 | 0.002 | 0.0033 | 0.01 | | | 0.01 | 0.021 | | 0.0022 | | | 0.0000 |
| 110 | 0.081 | 0.45 | 2.22 | 0.026 | 0.013 | 0.003 | 0.0027 | 0.02 | 0.01 | 0.01 | 0.01 | 0.019 | | 0.0021 | | | 0.0040 |
| 111 | 0.083 | 0.45 | 2.23 | 0.023 | 0.013 | 0.002 | 0.0029 | 0.02 | 0.03 | 0.20 | 0.02 | 0.020 | | 0.0020 | 0.0100 | Sb: 0.0010 | 0.0390 |
| 112 | 0.210 | 0.10 | 3.10 | 0.033 | 0.014 | 0.003 | 0.0035 | 0.03 | 0.03 | 0.05 | 0.02 | 0.023 | | 0.0023 | 0.0200 | | 0.0340 |
| 113 | 0.240 | 0.27 | 3.05 | 0.027 | 0.018 | 0.002 | 0.0037 | 0.02 | 0.05 | 0.05 | 0.01 | 0.027 | | 0.0021 | 0.0400 | | 0.0600 |
| 114 | 0.005 | 0.01 | 0.44 | 0.024 | 0.009 | 0.003 | 0.0023 | 0.01 | 0.02 | 0.01 | | | | | | | 0.0070 |
| 115 | 0.084 | 0.44 | 2.20 | 0.023 | 0.014 | 0.002 | 0.0027 | 0.01 | 0.01 | | | | | | 0.0008 | | 0.0038 |
| 116 | 0.210 | 0.75 | 2.61 | 0.032 | 0.012 | 0.003 | 0.0033 | 0.02 | | 0.03 | | 0.031 | | 0.0018 | 0.0005 | | 0.0035 |

TABLE 1-1-continued

| Steel | Chemical composition (mass %), balance Fe and impurities | | | | | | | | | | | | | | | | Formula |
|---|---|---|---|---|---|---|---|---|---|---|---|---|---|---|---|---|---|
| no. | C | Si | Mn | Al | P | S | N | Ni | Cu | Cr | Mo | Ti | Nb | B | Sn | Others | (1') |
| 117 | 0.090 | 0.43 | 2.50 | 0.024 | 0.011 | 0.003 | 0.0037 | 0.02 | 0.05 | | 0.02 | 0.021 | | 0.0019 | | | 0.0150 |
| 118 | 0.108 | 0.27 | 0.99 | 0.021 | 0.015 | 0.004 | 0.0031 | 0.03 | | 0.08 | 0.01 | | | 0.0011 | | | 0.0080 |
| 119 | 0.081 | 0.42 | 2.25 | 0.028 | 0.014 | 0.002 | 0.0033 | 0.01 | | | 0.01 | 0.021 | | 0.0022 | 0.0004 | | 0.0004 |
| 120 | 0.082 | 0.43 | 2.19 | 0.024 | 0.011 | 0.002 | 0.0028 | 0.01 | 0.03 | 0.39 | | | 0.001 | | 0.0008 | | 0.0488 |
| 121 | 0.182 | 0.14 | 2.01 | 0.450 | 0.012 | 0.002 | 0.003 | 0.01 | 0.03 | 0.21 | 0.01 | 0.0230 | | 0.0023 | 0.0003 | | 0.0303 |
| 122 | 0.082 | 0.43 | 2.19 | 0.024 | 0.011 | 0.002 | 0.0028 | 0.01 | 0.03 | 0.39 | | | 0.001 | | 0.0008 | | 0.0488 |
| 123 | 0.082 | 0.43 | 2.19 | 0.024 | 0.011 | 0.002 | 0.0028 | 0.01 | 0.03 | 0.39 | | | 0.001 | | 0.0008 | | 0.0488 |
| 124 | 0.089 | 0.45 | 2.02 | 0.023 | 0.010 | 0.004 | 0.0029 | 0.01 | 0.03 | 0.11 | | 0.020 | | 0.0030 | | V: 0.01 | 0.0200 |
| 125 | 0.091 | 0.44 | 2.00 | 0.020 | 0.009 | 0.003 | 0.0031 | 0.01 | 0.03 | 0.11 | | 0.022 | | 0.0028 | | W: 0.02 | 0.0200 |
| 126 | 0.090 | 0.44 | 2.05 | 0.021 | 0.010 | 0.003 | 0.0027 | 0.01 | 0.03 | 0.11 | | 0.023 | | 0.0030 | | Ca: 0.0060 | 0.0200 |
| 127 | 0.089 | 0.46 | 2.08 | 0.023 | 0.010 | 0.004 | 0.0034 | 0.01 | 0.03 | 0.11 | | 0.020 | | 0.0030 | | REM: 0.0020 | 0.0200 |

TABLE 1-2

| | Cooling step | | Pickling step | | | | | | | | |
|---|---|---|---|---|---|---|---|---|---|---|---|
| | Average | Cooling | Hydrochloric | Sulfuric acid | Oxide film | | | Tensile | Chemical | End-face | |
| Steel no. | cooling speed (° C./s) | stop temp. (° C.) | acid first pickling | second pickling | Thickness (nm) | A/C | B/C | strength (MPa) | convert-ability | corrosion resistance | Remarks |
| 101 | 51 | 620 | ✓ | ✓ | 33 | 0.02 | 1.1 | 451 | Good | Good | Ex. |
| 102 | 65 | 610 | ✓ | ✓ | 31 | 0.05 | 1.5 | 614 | Good | Good | Ex. |
| 103 | 66 | 600 | ✓ | ✓ | 44 | 0.22 | 2.0 | 1025 | Good | Good | Ex. |
| 104 | 81 | 600 | ✓ | ✓ | 37 | 0.19 | 2.9 | 820 | Fair | Good | Ex. |
| 105 | 57 | 630 | ✓ | ✓ | 29 | 0.19 | 0.6 | 1515 | Good | Good | Ex. |
| 106 | 52 | 580 | ✓ | ✓ | 41 | 0.27 | 2.3 | 1230 | Good | Good | Ex. |
| 107 | 64 | 600 | ✓ | ✓ | 40 | 0.25 | 2.6 | 1043 | Good | Good | Ex. |
| 108 | 58 | 610 | ✓ | ✓ | 31 | 0.33 | 4.0 | 825 | Poor | Good | Comp. ex. |
| 109 | 58 | 590 | ✓ | ✓ | 24 | 0.15 | 0.5 | 833 | Good | Poor | Comp. ex. |
| 110 | 63 | 560 | ✓ | ✓ | 15 | 0.20 | 0.5 | 811 | Good | Good | Ex. |
| 111 | 74 | 640 | ✓ | ✓ | 17 | 0.22 | 2.3 | 822 | Good | Good | Ex. |
| 112 | 55 | 630 | ✓ | ✓ | 31 | 0.10 | 1.7 | 1530 | Good | Good | Ex. |
| 113 | 58 | 620 | ✓ | ✓ | 40 | 0.19 | 4.3 | 1550 | Poor | Good | Comp. ex. |
| 114 | 61 | 560 | ✓ | ✓ | 12 | 0.22 | 1.5 | 321 | Good | Poor | Comp. ex. |
| 115 | 62 | 570 | ✓ | ✓ | 15 | 0.18 | 2.4 | 825 | Good | Good | Ex. |
| 116 | 57 | 600 | ✓ | ✓ | 22 | 0.16 | 1.8 | 1230 | Good | Good | Ex. |
| 117 | 73 | 600 | ✓ | ✓ | 31 | 0.09 | 1.6 | 1025 | Good | Good | Ex. |
| 118 | 60 | 580 | ✓ | ✓ | 34 | 0.04 | 0.5 | 455 | Good | Good | Ex. |
| 119 | 54 | 630 | ✓ | ✓ | 27 | 0.14 | 0.9 | 830 | Good | Good | Ex. |
| 120 | 70 | 620 | ✓ | ✓ | 23 | 0.25 | 2.7 | 820 | Fair | Good | Ex. |
| 121 | 61 | 610 | ✓ | ✓ | 31 | 0.15 | 1.1 | 1221 | Good | Good | Ex. |
| 122 | 61 | 610 | ✓ | X | 61 | 0.35 | 2.9 | 1235 | Poor | Good | Comp. ex. |
| 123 | 61 | 600 | X | ✓ | 45 | 0.37 | 3.4 | 1243 | Poor | Good | Comp. ex. |
| 124 | 102 | 630 | ✓ | ✓ | 37 | 0.1 | 1.0 | 610 | Good | Good | Ex. |
| 125 | 82 | 640 | ✓ | ✓ | 30 | 0.1 | 2.2 | 621 | Good | Good | Ex. |
| 126 | 63 | 600 | ✓ | ✓ | 40 | 0.1 | 1.5 | 607 | Good | Good | Ex. |
| 127 | 78 | 620 | ✓ | ✓ | 35 | 0.2 | 2.1 | 612 | Good | Good | Ex. |

For Examples 101 to 107, 110 to 112, 115 to 121, and 124 to 127, the chemical compositions of the elements, the values found by Formula (1'), and the values of A/C and B/C were suitably controlled, therefore high strength cold rolled steel sheets maintaining end-face corrosion resistance while having improved chemical convertibility could be obtained. On the other hand, Comparative Examples 108 and 113 had high values found by Formula (1'), therefore were insufficient in chemical convertibility. Comparative Example 109 did not contain any of Sn, Cu, and Cr and had a value found by Formula (1') of 0.0000%. For this reason, the end-face corrosion resistance was insufficient. Comparative Example 114 had insufficient amounts of C, Si, and Mn contributing to strength, had a tensile strength of less than 340 MPa, and had insufficient strength. Comparative Examples 122 and 123 only performed one treatment, as pickling, among the first pickling by hydrochloric acid and the second pickling by sulfuric acid after that, therefore the thickness of the oxide film became greater or the value of the A/C and/or B/C became higher, and as a result the chemical convertibility fell.

[Example Y (Corresponding to Embodiment 2): Production of Hot Rolled Steel Sheet]

First, molten steels suitably adjusted in chemical composition were cast to form steel slabs and the steel slabs were reheated to 1100° C., then hot rolled. Next, the finish rolled steel sheets were cooled under the cooling conditions shown in Table 2, coiled, then treated by predetermined pickling, specifically a first pickling by hydrochloric acid by an acid concentration of 9%, a pickling temperature of 90° C., and a pickling time of 60 seconds and a subsequent second pickling by sulfuric acid by an acid concentration of 15%, a pickling temperature of 90° C., and a pickling time of 60 seconds suitably combined for pickling treatment (for the specific combination of the first pickling and second pickling in each example, see Table 2). In all of the steel sheets, the end temperature of the finish rolling was 950° C., the rolling reduction of the finish rolling was 20%, and the coiling temperature was 600° C. All of the obtained hot rolled steel sheets had thicknesses of 2.0 mm. None of the hot rolled steel sheets were plated, i.e., none of the hot rolled steel sheets had plating layers containing at least one of Ni, Zn, and Co. The chemical compositions measured for samples obtained from the steel sheets are shown in Table 2. The empty fields in Table 2 show the contents were the detection limits or less and show the elements were not contained in the samples (content 0%). Further, for each sample, the values related to Formula (1) were calculated based on the obtained values of the Sn content, Cu content, and Cr content.

other hand, Comparative Example 209 had a high value found by Formula (1), therefore the chemical convertibility was insufficient. Comparative Example 212 did not contain any of Sn, Cu, and Cr and the value found by Formula (1) was 0.0000%. For this reason, the end-face corrosion resistance was insufficient. Comparative Example 210 had insufficient amounts of C, Si and Mn contributing to strength and had a tensile strength of less than 340 MPa therefore the the strength was insufficient. Comparative Example 216 was only treated, as pickling, by one of the first pickling by hydrochloric acid and the second pickling by sulfuric acid after that, therefore the value of A/C became high and as a result the chemical convertibility fell.

TABLE 2-1

| Steel | Chemical composition (mass%), balance Fe and impurities | | | | | | | | | | | | | | | | Formula |
|---|---|---|---|---|---|---|---|---|---|---|---|---|---|---|---|---|---|
| no. | C | Si | Mn | Al | P | S | N | Ni | Cu | Cr | Mo | Ti | Nb | B | Sn | Sb | (1) |
| 201 | 0.090 | 0.11 | 0.97 | 0.030 | 0.019 | 0.004 | 0.0037 | 0.02 | 0.05 | 0.22 | 0.01 | | | | 0.0030 | | 0.0400 |
| 202 | 0.052 | 0.12 | 1.34 | 0.033 | 0.015 | 0.003 | 0.0038 | 0.03 | 0.03 | 0.09 | 0.02 | 0.022 | | | 0.0020 | | 0.0200 |
| 203 | 0.051 | 0.93 | 1.28 | 0.041 | 0.017 | 0.002 | 0.0031 | 0.04 | 0.03 | 0.11 | 0.03 | 0.025 | 0.014 | | 0.0030 | | 0.0230 |
| 204 | 0.068 | 1.22 | 2.54 | 0.028 | 0.021 | 0.003 | 0.0035 | 0.03 | 0.04 | 0.20 | 0.01 | 0.027 | 0.019 | 0.0015 | 0.0010 | | 0.0330 |
| 205 | 0.065 | 1.19 | 2.55 | 0.021 | 0.028 | 0.003 | 0.0029 | 0.02 | 0.02 | 0.03 | 0.01 | 0.030 | 0.021 | 0.0019 | 0.0010 | | 0.0100 |
| 206 | 0.210 | 1.55 | 2.22 | 0.031 | 0.016 | 0.003 | 0.0028 | 0.01 | 0.01 | 0.01 | | | 0.020 | 0.0016 | | | 0.0040 |
| 207 | 0.221 | 0.21 | 1.38 | 0.025 | 0.018 | 0.002 | 0.0033 | 0.02 | 0.02 | 0.14 | | 0.020 | | 0.0022 | 0.0010 | 0.0010 | 0.0210 |
| 208 | 0.089 | 0.33 | 0.99 | 0.031 | 0.017 | 0.002 | 0.0035 | 0.05 | 0.18 | 0.85 | 0.01 | | | | 0.0100 | | 0.1490 |
| 209 | 0.091 | 0.11 | 1.00 | 0.027 | 0.015 | 0.002 | 0.0029 | 0.03 | 0.21 | 0.95 | 0.02 | | | | 0.0500 | | 0.2080 |
| 210 | 0.040 | 0.01 | 0.65 | 0.022 | 0.012 | 0.003 | 0.0024 | 0.02 | 0.01 | 0.02 | 0.01 | | | | 0.0010 | | 0.0060 |
| 211 | 0.210 | 0.12 | 3.13 | 0.031 | 0.018 | 0.002 | 0.0033 | | 0.02 | 0.10 | | 0.025 | | 0.0025 | 0.0010 | | 0.0170 |
| 212 | 0.087 | 0.12 | 0.95 | 0.013 | 0.016 | 0.004 | 0.0035 | 0.01 | | | | | | | | | 0.0000 |
| 213 | 0.093 | 0.13 | 0.92 | 0.031 | 0.018 | 0.003 | 0.0027 | 0.01 | 0.01 | 0.01 | | | | | | | 0.0040 |
| 214 | 0.093 | 0.12 | 0.94 | 0.025 | 0.012 | 0.004 | 0.0029 | 0.02 | | | 0.01 | | | | 0.0005 | | 0.0005 |
| 215 | 0.071 | 1.23 | 2.56 | 0.028 | 0.023 | 0.003 | 0.0035 | 0.03 | | 0.20 | 0.01 | 0.027 | 0.019 | 0.0015 | | | 0.0200 |
| 216 | 0.089 | 0.33 | 0.99 | 0.031 | 0.017 | 0.002 | 0.0035 | 0.05 | 0.18 | 0.85 | 0.01 | | | | 0.0100 | | 0.1490 |

TABLE 2-2

| | Cooling step | | Pickling step | | | | | | | | |
|---|---|---|---|---|---|---|---|---|---|---|---|
| | Average cooling | Cooling | Hydrochloric | Sulfuric acid | Oxide film | | | Tensile | Chemical | End-face | |
| Steel no. | speed (° C./s) | stop temp. (° C.) | acid first pickling | second pickling | Thickness (nm) | A/C | B/C | strength (MPa) | convert-ability | corrosion resistance | Remarks |
| 201 | 60 | 650 | ✓ | ✓ | 22 | 0.00 | 0.3 | 455 | Good | Good | Ex. |
| 202 | 75 | 620 | ✓ | ✓ | 14 | 0.10 | 0.5 | 612 | Good | Good | Ex. |
| 203 | 70 | 600 | ✓ | ✓ | 10 | 0.08 | 0.0 | 798 | Good | Good | Ex. |
| 204 | 55 | 590 | ✓ | ✓ | 15 | 0.11 | 0.2 | 1011 | Good | Good | Ex. |
| 205 | 59 | 630 | ✓ | ✓ | 13 | 0.22 | 1.0 | 1241 | Good | Good | Ex. |
| 206 | 58 | 620 | ✓ | ✓ | 16 | 0.15 | 0.9 | 1228 | Good | Good | Ex. |
| 207 | 81 | 580 | ✓ | ✓ | 20 | 0.05 | 0.3 | 633 | Good | Good | Ex. |
| 208 | 66 | 640 | ✓ | ✓ | 21 | 0.22 | 2.8 | 465 | Fair | Good | Ex. |
| 209 | 51 | 620 | ✓ | ✓ | 14 | 0.21 | 4.4 | 471 | Poor | Good | Comp. ex. |
| 210 | 77 | 590 | ✓ | ✓ | 14 | 0.06 | 1.4 | 333 | Good | Good | Comp. ex. |
| 211 | 70 | 550 | ✓ | ✓ | 16 | 0.02 | 1.6 | 1559 | Good | Good | Ex. |
| 212 | 59 | 520 | ✓ | ✓ | 19 | 0.11 | 0.1 | 460 | Good | Poor | Comp. ex. |
| 213 | 68 | 630 | ✓ | ✓ | 10 | 0.13 | 1.0 | 454 | Good | Good | Ex. |
| 214 | 56 | 600 | ✓ | ✓ | 11 | 0.16 | 0.6 | 451 | Good | Good | Ex. |
| 215 | 57 | 600 | ✓ | ✓ | 13 | 0.09 | 0.2 | 1010 | Good | Good | Ex. |
| 216 | 57 | 600 | X | ✓ | 44 | 0.50 | 1.5 | 473 | Poor | Good | Comp. ex. |

Regarding Examples 201 to 208, 211, and 213 to 215, the chemical compositions of the elements, the values found by Formula (1), and the values of A/C and B/C were suitably controlled, therefore high strength hot rolled steel sheets maintaining the end-face corrosion resistance while having improved chemical convertibility could be obtained. On the

[Example Z: Relationship Between A/C and B/C in Oxide Film]

FIG. 1 is a view of evaluations relating to chemical convertibility of the examples in Examples X and Y (○ (good), Δ (fair), and x (poor)) when plotting the A/C values along the abscissa and the B/C values along the ordinate.

Referring to FIG. 1, it is learned that by controlling the A/C and B/C values in the oxide film formed on the steel sheet surface so as to respectively satisfy A/C<0.30 and B/C<3.0 to render the composition of the oxide film more Mn-rich oxides, it is possible to remarkably improve the chemical convertibility of the thin steel sheet.

Figure 2:
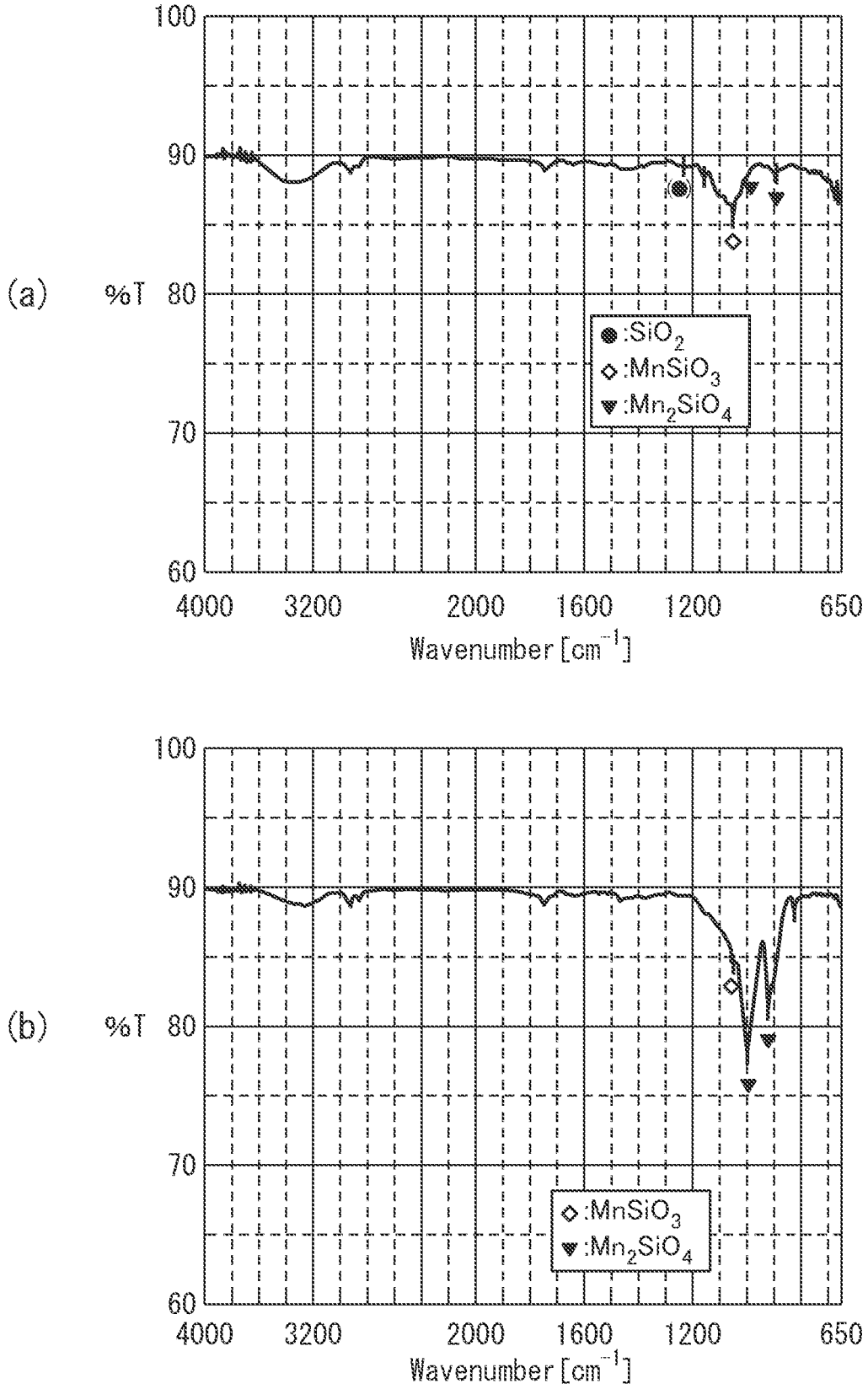
FIG. 2 shows an infrared absorption spectrum obtained by measurement by the FT-IR reflectance method.

By way of reference, FIG. 2 shows the infrared absorption spectrum obtained by measurement by the FT-IR reflectance method. FIG. 2(*a*) corresponds to cold rolled steel sheet not satisfying B/C<3.0 of Formula (3) and as a result not able to achieve excellent chemical convertibility. On the other hand, FIG. 2(*b*) corresponds to cold rolled steel sheet satisfying Formulas (2) and (3) and as a result achieving excellent chemical convertibility. Referring to these, in FIG. 2(*a*), it is learned that compared with the case of FIG. 2(*b*), the area of the peak derived from $Mn_2SiO_4$ detected near 920 $cm^{-1}$ is smaller and therefore the ratio of Mn-rich oxides is smaller.

INDUSTRIAL APPLICABILITY

According to the present invention, it becomes possible to provide a high strength thin steel sheet maintaining end-face corrosion resistance while having improved chemical convertibility. The thin steel sheet can be suitably used for automobiles, household electric appliances, building materials, and other applications, in particular for automobiles. Therefore, the present invention can be said to be an invention with extremely high value in industry.

The invention claimed is:

1. A steel sheet having a chemical composition comprising, by mass %,

C: 0.050 to 0.300%,
Si: 0.10 to 4.00%,
Mn: 0.80 to 6.00%,
Al: 0.010 to 2.000%,
P: 0 to 0.100%,
S: 0 to 0.100%,
N: 0 to 0.0300%,
Ni: 0 to 0.05%,
Cu: 0 to 0.50%,
Cr: 0 to 1.00%,
Mo: 0 to 0.50%,
Ti: 0 to 0.200%,
Nb: 0 to 0.100%,
B: 0 to 0.0200%,
Sn: 0 to 0.2000%,
Sb: 0 to 0.0300%,
V: 0 to 0.50%,
W: 0 to 0.50%,
Ca: 0 to 0.0100%,
REM: 0 to 0.0100%, and
balance: Fe and impurities, and satisfying the following formula (1), and
an oxide film having a thickness of 50 nm or less on its surface, and satisfying the following formulas (2) and (3), wherein the oxide film is measured by an FT-IR reflectance method:

$$0.0001 \le [Sn] + 0.3[Cu] + 0.1[Cr] \le 0.2000 \quad (1)$$

where [Sn], [Cu] and [Cr] respectively are the contents, in mass %, of Sn, Cu and Cr, $$A/C < 0.30 \quad (2)$$

$$B/C < 3.0 \quad (3)$$

where A is an area of a peak derived from $SiO_2$, B is an area of a peak derived from $MnSiO_3$, and C is an area of a peak derived from $Mn_2SiO_4$.

2. The steel sheet according to claim 1, wherein the steel sheet is a hot rolled steel sheet.

3. The steel sheet according to claim 1, wherein the chemical composition comprises, by mass %, Cu: 0 to 0.10%,
Cr: 0 to 0.50%, and
Sn: 0 to 0.0500%, and satisfies the following formula (1'), and
the steel sheet is a cold rolled steel sheet:

$$0.0001 \le [Sn] + 0.3[Cu] + 0.1[Cr] \le 0.0500 \quad (1')$$

where [Sn], [Cu] and [Cr] respectively are the contents, in mass %, of Sn, Cu and Cr.

4. The steel sheet according to claim 1, not having on the surface of the steel sheet, a plating layer having a chemical composition comprising at least one of Ni, Zn and Co and balance of Fe and impurities.

5. The steel sheet according to claim 1, having a tensile strength of 340 MPa or more.

6. The steel sheet according to claim 1, having a tensile strength of 440 MPa or more.

7. The steel sheet according to claim 1, wherein the steel sheet is a cold rolled steel sheet, and wherein the steel sheet satisfies 0.0001≤[Sn]+0.3 [Cu]+0.1 [Cr]≤0.0500.

8. The steel sheet according to claim 1, wherein the steel sheet is a thin steel sheet having a thickness of 0.1 to 4.0 mm.

9. The steel sheet according to claim 1, wherein the steel sheet satisfies:

0.0003≤[Sn]+0.3[Cu]+0.1[Cr]≤0.2000.

10. The steel sheet according to claim 1, wherein the steel sheet satisfies:

0.0004≤[Sn]+0.3[Cu]+0.1[Cr]≤0.2000.

11. The steel sheet according to claim 1, wherein the steel sheet satisfies:

0.0005≤[Sn]+0.3[Cu]+0.1[Cr]≤0.2000.

* * * * *